US011117149B2

(12) United States Patent
Holtzman

(10) Patent No.: US 11,117,149 B2
(45) Date of Patent: Sep. 14, 2021

(54) SYSTEMS, METHODS, AND APPARATUSES FOR A CARTRIDGE DISPENSING SYSTEM AND RETENTION MECHANISM

(71) Applicant: IM Pro Makeup NY LP, New York, NY (US)

(72) Inventor: Oran Holtzman, New York, NY (US)

(73) Assignee: IM PRO MAKEUP NY LP, New York, NY (US)

( * ) Notice: Subject to any disclaimer, the term of this patent is extended or adjusted under 35 U.S.C. 154(b) by 0 days.

(21) Appl. No.: 16/947,933

(22) Filed: Aug. 24, 2020

(65) Prior Publication Data

US 2021/0053081 A1 Feb. 25, 2021

Related U.S. Application Data

(60) Provisional application No. 62/890,565, filed on Aug. 22, 2019.

(51) Int. Cl.
*B05B 11/00* (2006.01)

(52) U.S. Cl.
CPC ..... *B05B 11/3047* (2013.01); *B05B 11/0054* (2013.01); *B05B 11/0078* (2013.01); *B05B 11/3074* (2013.01)

(58) Field of Classification Search
USPC ..... 222/321.7, 321.9, 321.1, 182, 183, 325, 222/327, 383.1, 153.09
See application file for complete search history.

(56) References Cited

U.S. PATENT DOCUMENTS 6,053,363 A * 4/2000 Revenu ..... B05B 11/0038 222/82
6,305,580 B1 * 10/2001 Chen ..... B05B 11/3056 222/162
6,983,864 B1 * 1/2006 Cagle ..... B05B 11/0005 222/131
8,596,498 B2 * 12/2013 Werner ..... B05B 11/3083 222/136
8,893,927 B2 * 11/2014 Olson ..... B01F 5/0496 222/162
10,149,527 B2 * 12/2018 Thorez ..... A45D 34/00
2004/0050869 A1 * 3/2004 Jennings ..... B05B 11/3056 222/183
2014/0291351 A1 * 10/2014 Kang ..... B29C 51/162 222/105
2016/0199864 A1 * 7/2016 Quennessen ..... B05B 11/3083 222/135

(Continued)

*Primary Examiner* — Lien M Ngo
(74) *Attorney, Agent, or Firm* — Duncan Galloway Egan Greenwald PLLC; Kevin T. Duncan

(57) ABSTRACT

The present application relates to the design of a class of beauty products that facilitates personalized replenishment. The physical product is a new type of case comprising one or two sides or chambers, where each chamber retains a cartridge of a specific type of product, such as a foundation. For example, in an embodiment where the case of the present invention comprises a single chamber product, the cartridge may contain a single type of foundation. In an embodiment where the present invention comprises a case capable of retaining two cartridges, or comprises two product chambers, one cartridge may hold a relatively lightweight foundation, and the other may hold a long-wear foundation.

15 Claims, 27 Drawing Sheets

(56) References Cited

U.S. PATENT DOCUMENTS

| | | | | |
|---|---|---|---|---|
| 2016/0227902 | A1* | 8/2016 | Mather | B05B 11/0032 |
| 2017/0028421 | A1* | 2/2017 | Martines | B05B 11/3049 |
| 2019/0200812 | A1* | 7/2019 | Toh | A47K 5/1201 |
| 2020/0023391 | A1* | 1/2020 | Cesare | B65D 47/0809 |

* cited by examiner

DETAIL E

DETAIL A

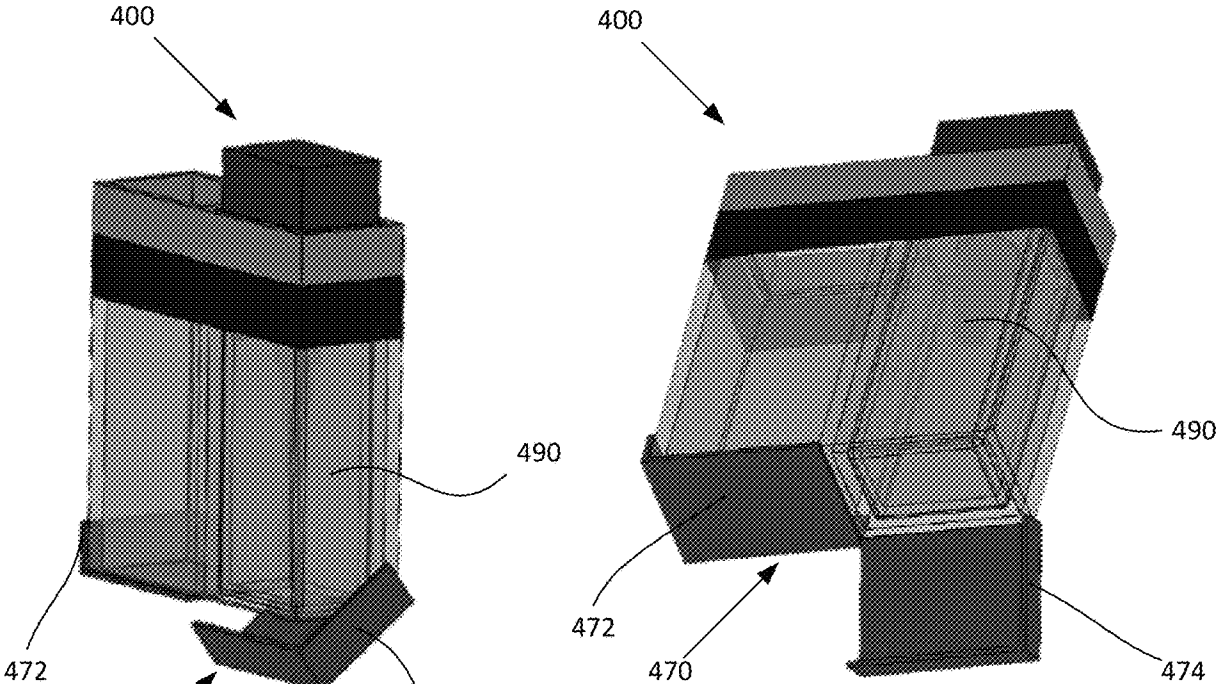
FIG. 24
FIG. 25
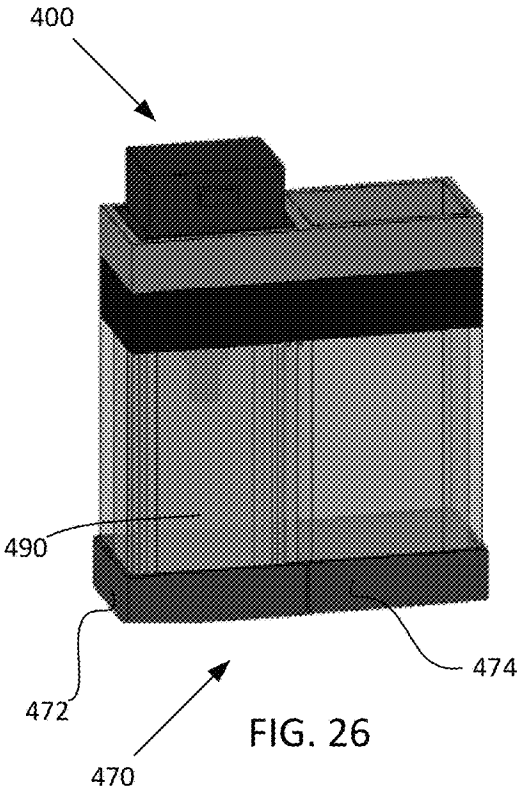
FIG. 26

SYSTEMS, METHODS, AND APPARATUSES FOR A CARTRIDGE DISPENSING SYSTEM AND RETENTION MECHANISM

CROSS-REFERENCE AND CLAIM OF PRIORITY

The present application claims the benefit of priority to U.S. Provisional Pat. App. No. 62/890,565, entitled SYSTEMS, METHODS, AND APPARATUSES FOR A CARTRIDGE DISPENSING SYSTEM AND RETENTION MECHANISM, filed 22 Aug. 2019, by Holtzman, which is incorporated by reference herein in its entirety.

FIELD OF THE INVENTION

The present application relates to the design of a class of beauty products that facilitates personalized replenishment.

BACKGROUND OF THE INVENTION

There are some beauty products, including foundation, skincare, concealer, primer, and a range of other complex beauty products, that consumers replenish frequently. For these products, rather than seeking newness and variety, consumers consistently purchase the same product. Due to all the packaging typically used with beauty products, replenishing a consumer's product is expensive. High-end brands can have especially expensive packaging and ecommerce brands may be burdened with the extra expense of shipping costs based on volume and weight. This means the consumer ends up with a high price tag for no reason.

What is needed is a product that provides for less expensive replenishment while maintaining an elevated consumer experience that is both seamless and fun. Such a product would increase customer loyalty to the brand providing it by dramatically decreasing the cost to the consumer of replenishing product while maintaining the same or an improved customer experience.

Such a replenishment mechanism would also enable the brand to launch a subscription service. In beauty today, we see "trial" subscription services where the consumer receives recurring shipments of mystery boxes with different product assortments. However, we do not see any companies that are successful in selling either single-brand or fixed-product subscriptions.

Another challenge in the beauty industry today is sustainability. The large amount of packaging used for beauty products is of increasing concern within today's political climate and among younger consumers.

What is needed is a product that can deliver an equally elevated consumer experience while requiring less packaging.

Finally, to achieve their desired transformation for various occasions, consumers use multiple liquid/gel beauty products at the same time. For example, they might use primer and foundation, foundation and concealer or two types of foundation. They might use both products at the same time in order to get results on different areas of their face, or they may use one product on some occasions and another product or combination of products in other cases. They likely use these products up at a difference cadence.

What is needed is (1) a way for the consumer to replenish products based on their individual needs and the cadence at which they use up each product and (2) the ability to carry a single product that can deliver the benefits of multiple products

SUMMARY OF THE INVENTION

The present invention is a product that supports ongoing replenishment. It makes it less expensive for a company to replenish the consumer's product and, therefore, it makes it less expensive for the consumer to continue buying the same product. This increases loyalty. The replenishment mechanism also has a lower environmental impact, resonating with consumer values. The replenishment experience is seamless and fun for the consumer. Finally, in some embodiments, the product contains multiple types of product within the same package. This means that consumers can carry a single product while still realizing the benefits of multiple product types.

In a first embodiment the present invention comprises an air-less cartridge dispensing system for dispensing a product, such as a fluid make-up product, by a manually operated pump. A cartridge carrier is disposed within a one or two-piece housing and holds an air-less cartridge. The carrier may be rotated, such as by 30 degrees, to disengage the carrier from a set of locking tabs, lugs, pins, or ramps to permit the carrier to be partially removed from the housing. A cartridge may then be removed and/or inserted into the carrier. After inserting the cartridge, the carrier may be reinserted into the housing and rotated, e.g., counter-rotated, to engage a set of locking tabs, lugs, pins, or ramps. When locked, a pump assembly at the top of the dispenser penetrates a seal on the cartridge to permit flow of a product from the cartridge through the pump assembly to be dispensed. The cartridge may be replaced when emptied or as desired by the user to permit dispensing of alternate product types. A replaceable or resealable cap may be used with the cartridge to re-seal the cartridge after a first-use or tamper seal has been breached by the pump assembly.

In another embodiment the physical product is a new type of case comprising one or two sides or chambers, where each chamber retains a cartridge of a specific type of product, such as a foundation. For example, in an embodiment where the case of the present invention comprises a single chamber product, the cartridge may contain a single type of foundation. In an embodiment where the present invention comprises a case capable of retaining two cartridges, or comprises two product chambers, one cartridge may hold a relatively lightweight foundation, and the other may hold a long-wear foundation. Alternatively, in the second example, one chamber may hold a primer and the other a moisturizer. On a day to day basis, the consumer may access a set of pumps, each pump operating one of the cartridges in the case, by lifting or removing a lid of the case and then pumping out either of the products in the cartridges from either side.

When the consumer uses up or depletes either type of product below a desirable level, the consumer can easily replace them. For example, the consumer may open or remove the bottom of the case, which may swing open on a hinge or be completely removable. The consumer then removes the used cartridge of product and replaces it with a new cartridge of the same or other type of product. The consumer then closes the case and proceeds to use the case as before. The process of replacing the cartridge provides an improved configuration that is mess-free and spill-proof. The design may leverage air-less technology which uses a vacuum to pump the product out of the cartridge through the pump without need for a tube. The cartridges in this manner provided added benefit as they are comprised of significantly thinner material than the exterior case and are therefore significantly less expensive to make and less expensive to ship. They also have a reduced environmental impact. To make it easy for the consumer to refill the product correctly—specifically to make sure they are replacing a used cartridge with the same type of product—the cartridges are designed with different patterns that are easily recognizable.

The present invention may be applied to a wide range of beauty products. The same air-less pump and replaceable cartridge technology can be applied to any liquid or gel beauty product.

The present invention also provides for a beauty subscription service that is the first of its kind. This subscription could be for any type of frequently replenished liquid or gel makeup or skincare. For example, for a subscription leveraging the dual-cartridge case of the present invention, the consumer would initially receive the exterior case and a set of cartridges, each with a different type of product. The consumer would then subscribe to receive regular deliveries of cartridges, which they would use to refill the exterior case. The cadence of the deliveries could be customized to the consumer's usage speed for both types of products. Due to the more limited packaging of the cartridges, the shipping costs would be relatively low compared to shipping a traditional product case. The reduced shipping costs plus the reduced packaging costs would enable this service and product to be provided to consumers at a lower cost relative to a subscription service using traditional product packaging. The consumer experience would remain elevated due to the ease and fun of replacing the product cartridges.

In one embodiment the present invention comprises a dual-cartridge case. In this embodiment, a cap of the case may be used to cover a set of air-less pumps. In this embodiment, the case is two-sided. Each side may hold an air-less cartridge comprising a different type of product. Each side of the case may have a separate air-less pump so that the consumer can pump out either type of product.

The bottom of the exterior of the case may be hinged. In one embodiment, the bottom remains securely in place during normal use but can easily be opened by the consumer in order to replace the cartridges. The two cartridges inside the case are independent, so the consumer can replace one while leaving the other. The consumer may remove a used cartridge through the bottom and then insert a new one to replace it. The cartridges may also be retained by other mechanisms including a push-push retention mechanism employing a tracked cam, an internal ledge operated by a release, or by a spring-operated piston ejector.

Each type of cartridge may have a different pattern so that it is easier for consumers to make sure that they are replacing a used cartridge with the correct type of new cartridge. The cartridges may also have the product type printed on the cartridge.

In one embodiment, the present invention provides a dispenser for dispensing a product from a cartridge, the dispenser comprising: a pump assembly; an upper retaining cover comprising a neck and a set of locking tracks; a lower retaining cover; a sleeve secured at a top end to the upper retaining cover, the sleeve comprising a locking tab and an alignment tab at a bottom of the sleeve; a cartridge carrier comprising: an upper collar comprising a set of locking pins and a set of alignment tabs; a body comprising a cartridge opening, a set of alignment edges, and a locking notch; and a bottom plate; wherein the cartridge carrier is adapted to be inserted into the sleeve such that the locking tab and the alignment tab of the sleeve align and guide the set of alignment edges of the body of the carrier as the carrier is moved upwards into the sleeve; wherein the locking tab of the sleeve moves correspondingly to the locking notch of the body of the carrier to guide the set of locking pins of the carrier into a locking engagement with the set of locking tracks of the upper retaining cover.

The dispenser the above embodiment may further comprise, wherein the cartridge carrier is adapted to receive, secure, and position a cartridge in the cartridge opening. The cartridge carrier may be adapted to move the cartridge into an engaged position with the pump assembly such that a product in the cartridge may be dispensed by operation of the pump. The sleeve may be a glass sleeve. The sleeve may further comprise a cutout at the bottom to permit a cartridge to be fully inserted into the sleeve. The dispenser may further comprise, wherein: the sleeve further comprises an upper alignment notch; and the upper retaining cover further comprises an alignment tab corresponding to the upper alignment notch of the sleeve to permit proper alignment between the sleeve and the upper retaining cover. The neck of the upper retaining cover may be a threaded neck and corresponds to a threaded collar of the pump assembly such that the threaded collar of the pump assembly may be threaded onto the threaded neck.

In another embodiment, the present invention provides a dispenser for dispensing a product from a cartridge, the dispenser comprising: a pump assembly; an upper retaining cover; a lower retaining cover; an inner sleeve comprising a neck, a set of locking tracks, a locking tab, and an alignment tab at a bottom of the inner sleeve, the inner sleeve secured at a top to the upper retaining cover; an outer sleeve corresponding to and disposed about the inner sleeve; a cartridge carrier comprising: an upper collar comprising a set of locking pins and a set of locking lugs; a body comprising a cartridge opening, a set of alignment edges, and a locking notch; and a bottom plate; wherein the cartridge carrier is adapted to be inserted into the inner sleeve such that the locking tab and the alignment tab of the inner sleeve align and guide the set of alignment edges of the body of the carrier as the carrier is moved upwards into the inner sleeve; wherein the locking tab of the inner sleeve moves correspondingly to the locking notch of the body of the carrier to guide the set of locking pins of the carrier into a locking engagement with the set of locking tracks of the inner sleeve.

The dispenser of the above embodiment may further comprise, wherein the cartridge carrier is adapted to receive, secure, and position a cartridge in the cartridge opening. The cartridge carrier may be adapted to move the cartridge into an engaged position with the pump assembly such that a product in the cartridge may be dispensed by operation of the pump. The inner sleeve may be a plastic sleeve and the outer sleeve may be a glass sleeve. The dispenser of the above embodiment may further comprise, wherein: the inner sleeve further comprises an upper alignment tab; and the upper retaining cover further comprises an alignment notch corresponding to the upper alignment tab of the inner sleeve to permit proper alignment between the inner sleeve and the upper retaining cover. The neck of the inner sleeve may be a threaded neck which corresponds to a threaded collar of the pump assembly such that the threaded collar of the pump assembly may be threaded onto the threaded neck. The neck of the inner sleeve may further comprise a locking collar adapted to secure the inner sleeve in a corresponding opening of the upper retaining cover. The set of locking lugs of the cartridge carrier may correspond to a set of recesses in the inner sleeve, and the set of locking lugs may be adapted to secure the cartridge carrier in a fully engaged or locked position to prevent undesired disengagement.

BRIEF DESCRIPTION OF THE DRAWINGS

In order to facilitate a full understanding of the present invention, reference is now made to the accompanying drawings, in which like elements are referenced with like numerals. These drawings should not be construed as limiting the present invention but are intended to be exemplary and for reference.

FIGS. 24-26 provide various views of an exterior case having a dual-hinged bottom retention mechanism for retaining a set of air-less cartridges according to an embodiment of the present invention.

DETAILED DESCRIPTION OF THE INVENTION

The present invention will now be described in more detail with reference to exemplary embodiments as shown in the accompanying drawings. While the present invention is described herein with reference to the exemplary embodiments, it should be understood that the present invention is not limited to such exemplary embodiments. Those possessing ordinary skill in the art and having access to the teachings herein will recognize additional implementations, modifications, and embodiments, as well as other applications for use of the invention, which are fully contemplated herein as within the scope of the present invention as disclosed and claimed herein, and with respect to which the present invention could be of significant utility.

Figure 1:
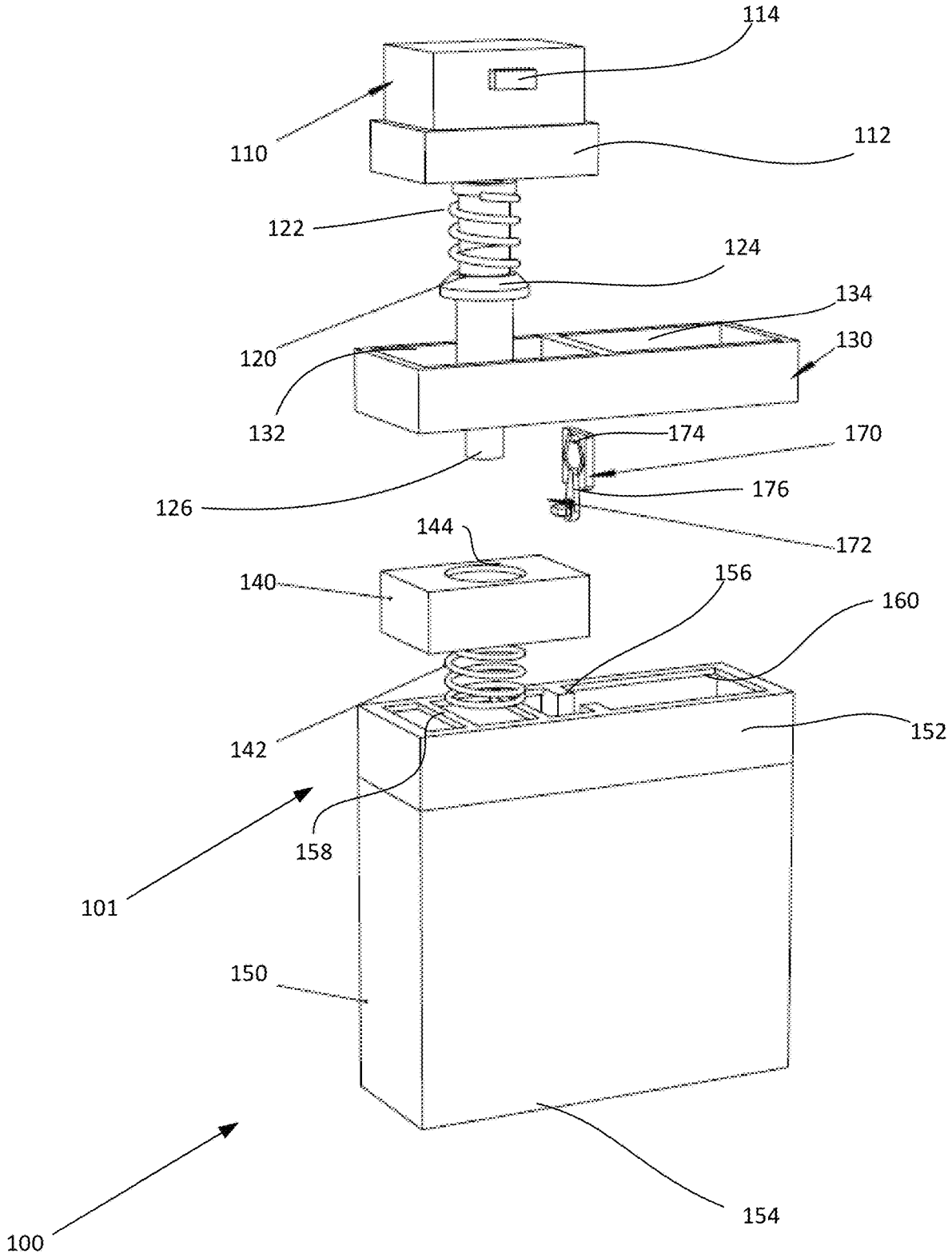
FIGS. 1-9 provide various views of an exterior case having a push-push cam-retention mechanism for retaining a set of air-less cartridges according to an embodiment of the present invention.
Figure 2:
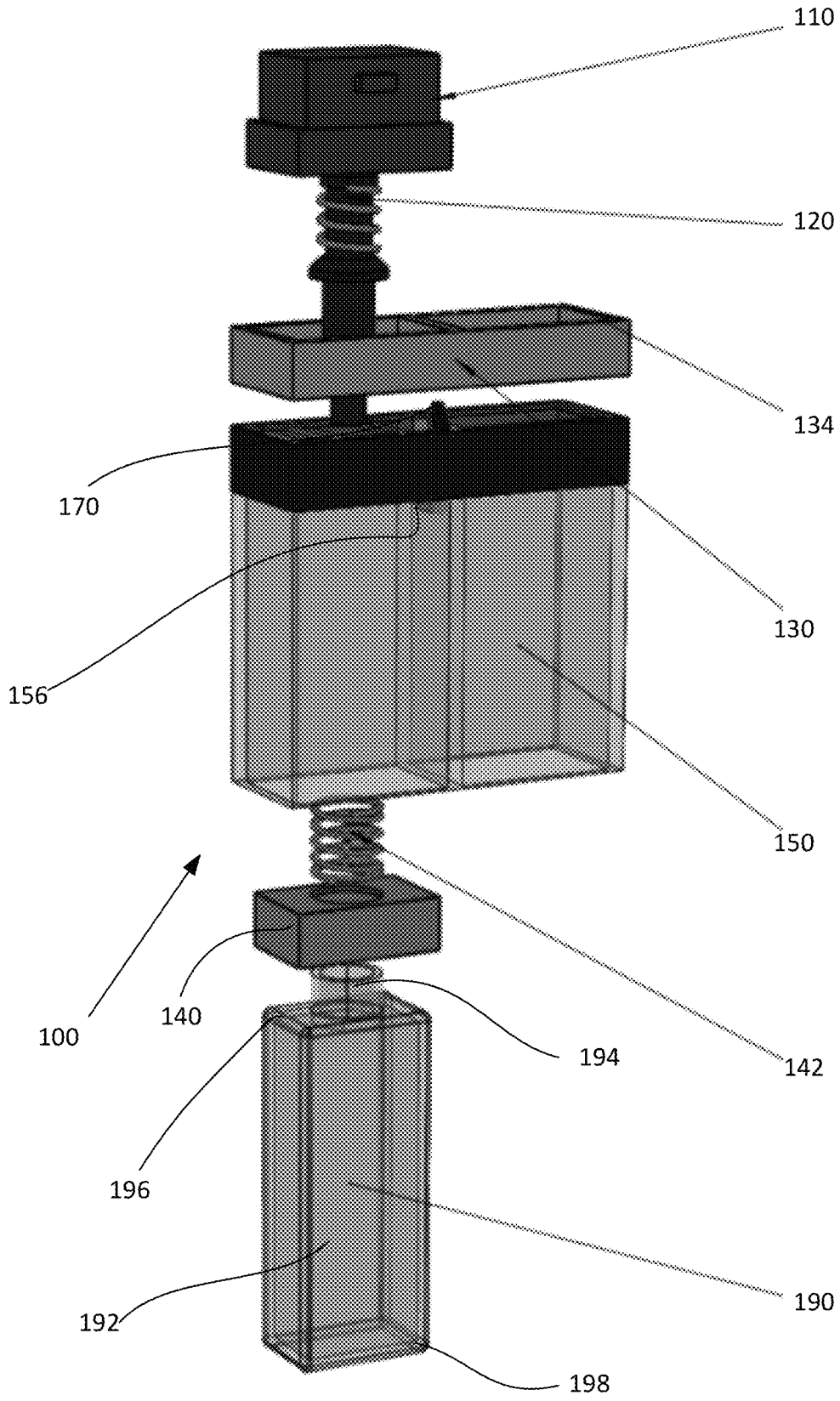
Figure 3:
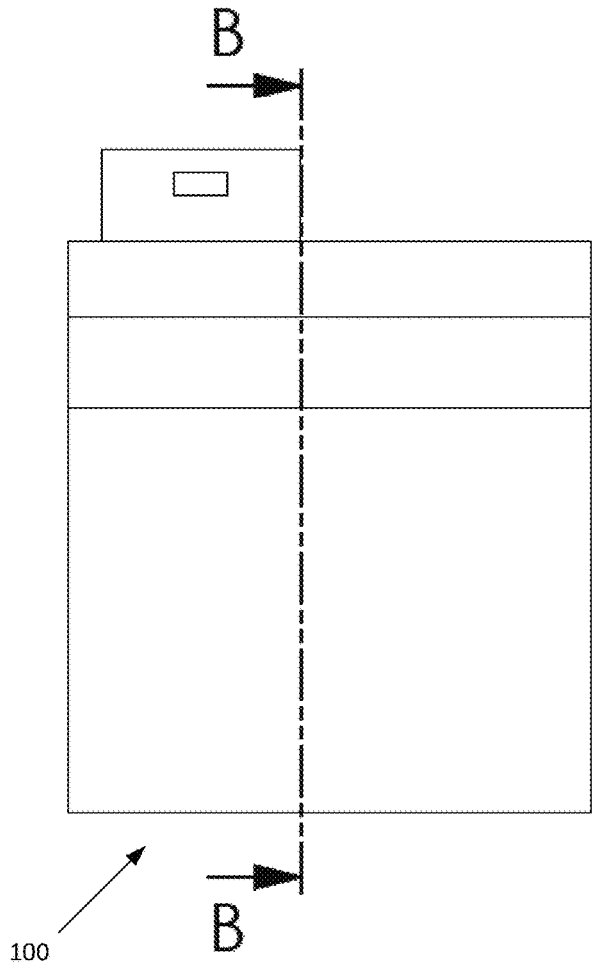
Figure 4:
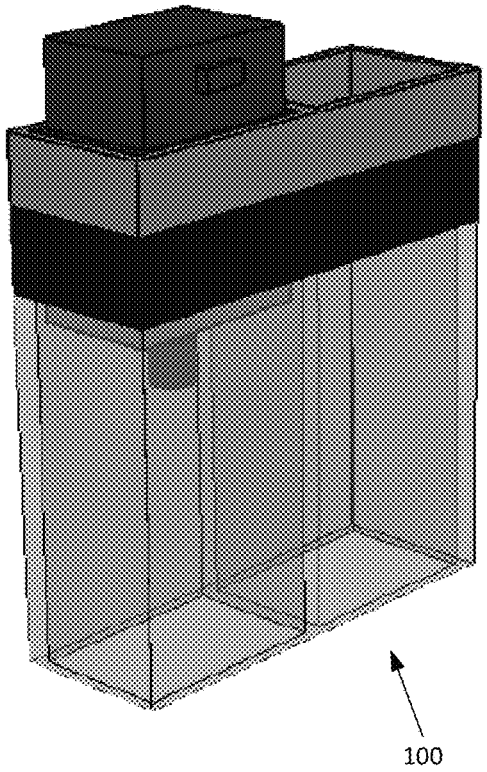

With reference now to FIGS. 1-9 various views of a dispensing system 100 comprising an exterior case 101 having a push-push cam-retention mechanism 170 for retaining a set of air-less cartridges 190 according to an embodiment of the present invention are provided. FIG. 1 provides an exploded view of the dispensing system 100. The dispensing system 100 comprises a case 101, dispenser 110, air-less pump 120, upper frame 130, cam sub-assembly 140, case frame 160, case 150, and cam-retention mechanism 170. The dispenser 110 comprises a spout or output 114 and a body or button 112. The air-less pump 120 operates by drawing a partial vacuum in a cartridge 190, shown in FIG. 2, and is operated by the button 112 of the dispenser 110. A pump spring 122 is disposed between the dispenser 110 and the flange 124 of the pump 120 and returns the dispenser 110 to a raised position after it is depressed by the user to dispense product in the cartridge 190. The upper frame 130 may comprise a first chamber 132 and a second chamber 134 to accommodate a first and second dispenser, pump, retention mechanism, and cartridge. The upper frame 130 may also retain the cam-retention mechanism 170 in the cam frame 156 in the case 150. The cam sub-assembly 140 comprises an opening 144 to permit the pump 120 to pass through and engage with the cartridge 190. In operation, the cam sub-assembly 140 would be disposed below the supports 158 in the interior of the case body 152 and case frame 160. The cartridge 190 interacts with the cam spring 142 to operate the cam arm 176 of the cam-retention mechanism 170.

Figure 5:
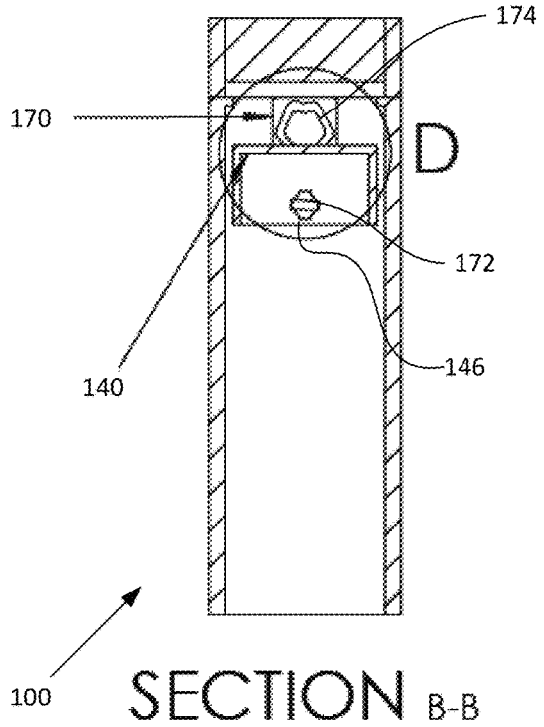
Figure 6:
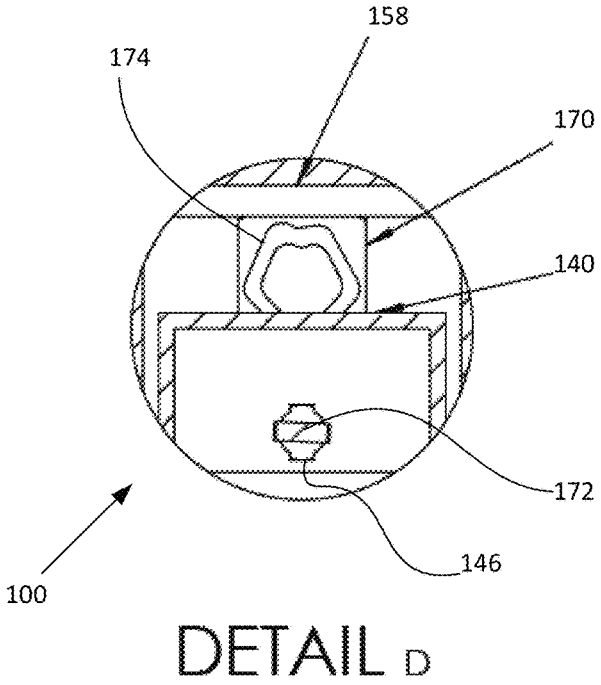
Figure 9:
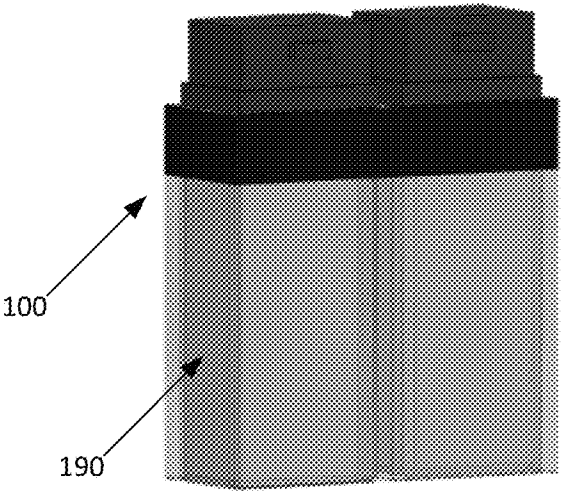
Figure 8:
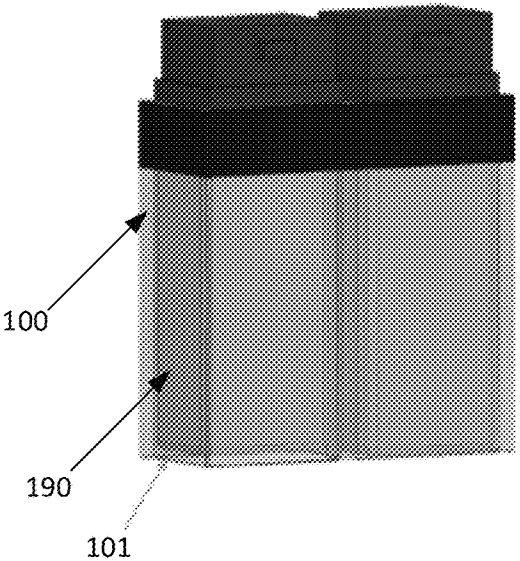
Figure 7:
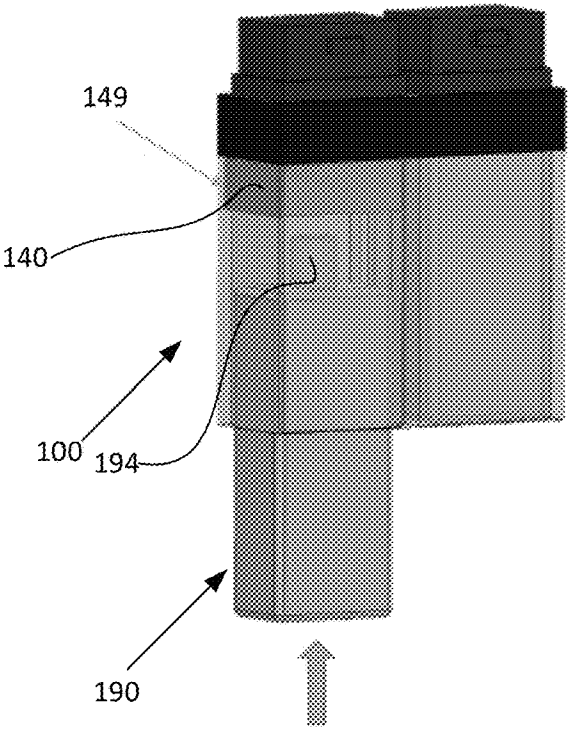

The operation of the cam-retention mechanism 170 is shown in detail in the cross-section B-B of FIG. 5 and detail section D of FIG. 6. As shown in FIGS. 2 and 5-9, the cartridge 190, which comprises an opening 194 at the top 196 and also comprises a body 192 and bottom 198, is inserted into the bottom 154 of the case 150. The top 196 of the cartridge 190 operates against the cam sub-assembly 140 and the bottom 126 of the pump 120 is inserted in the opening 194 of the cartridge 190. As the cartridge 190 is pushed upwards into the case 150, the cam sub-assembly 140 is correspondingly raised. This action rotates the cam arm 176 of the cam-retention mechanism 170 about the cam track 174, and the cam pin 172 rotates within the cam pin opening 146 of the cam sub-assembly 140. When the cam pin 172 rotates from a horizontal to a vertical position within the cam pin opening 146, the cam pin 172 locks the cartridge 190 in a retained or raised position. As shown in FIG. 8, the cartridge 190 is raised or inserted beyond a neutral or locked position 101 within the case 150. Spring pressure from the cam spring 142 keeps the cam sub-assembly 140 in the raised or locked position by keeping the cam pin 172 in a vertical orientation within the cam pin opening 146 and the cam arm 176 in a horizontal orientation until a user further presses the cartridge 190 into the case 150 in a second operation. By maintaining the cam sub-assembly 140 and cartridge 190 in a raised position, the cartridge is held in an operable position with the pump 120. Further operation of the cartridge 190 and cam sub-assembly 140 rotates the cam arm 176 about the cam track 174 to move the cam pin 172 into a horizontal orientation.

In the raised or locked position, the cam arm 176 is in a horizontal orientation and the cam pin 172 is in a vertical orientation, positioning the cam sub-assembly 140 closer to the supports 158 and engaging the cartridge 190 with the pump 120. In the lowered or unlocked position, the cam arm 176 is in a vertical orientation and the cam pin 172 is in a horizontal orientation, positioning the cam sub-assembly 140 further from the supports 158 and disengaging the cartridge 190 from the pump 120. When in the raised or locked position, the dispenser 110 may be used to operate the pump 120 to dispense product from the cartridge 190 until the product in the cartridge 190 is depleted. When the cartridge 190 is empty, it may be disengaged from the pump 120 and cam sub-assembly 140 by pressing the cartridge 190 inwards or up into the case 150. Once disengaged from the pump 120, the cartridge 190 may be removed from the case 150.

Typically, a user will insert the cartridge 190 until the user hears a small "click" sound from the cam pin 172 locking within the cam pin opening 146 of the cam sub-assembly 140. At that point the cartridge 190 is locked inside the case 150. To replace the cartridge 190, the user pushes the cartridge 190 and then the cartridge 190 is released from its lock and is able to be replaced. With the dispensing system 100, the pump 120 and cam sub-assembly 140 will be noticeable in the open position when no cartridge is inserted. Additionally, between replacement and when empty the air-less pump 120 may be noticeable by the user within the cartridge 190. The size of the case body 152 and case frame 160 may be adjusted to fully hide the pump 120 and cam sub-assembly 140 when no cartridge 190 is installed therein. A "puncher" may be used as part of the pump 120 or cam sub-assembly 140 to open a sealed cartridge 190 such that it may be engaged with the pump 120. A user may receive a sealed cartridge 190 and insert it into the case 150 while still sealed. The puncher then punctures the cartridge 190 to open it once it is inside of the case 150. This eliminates any mess and makes the process very easy for consumers.

Figure 10:
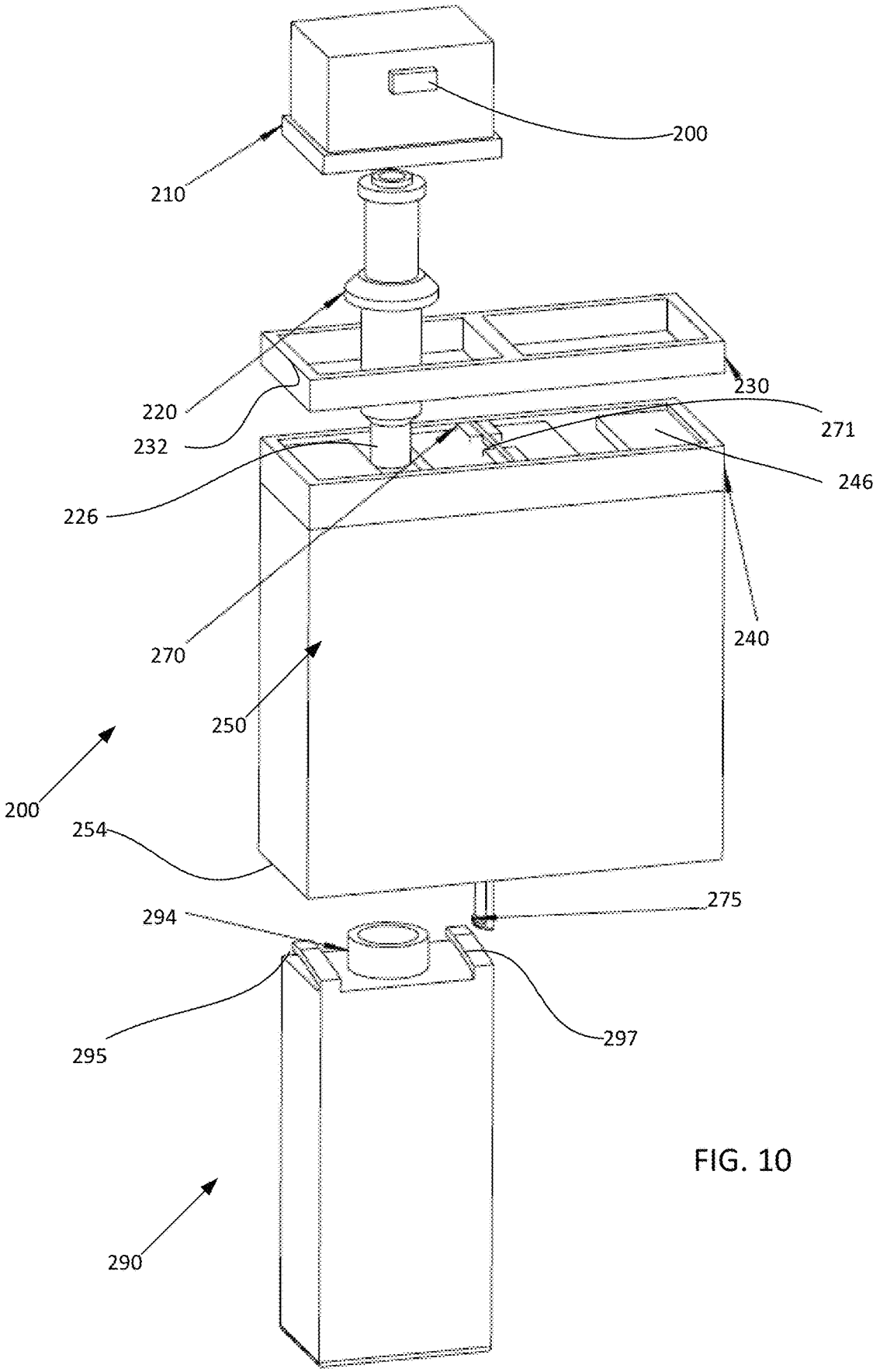
FIGS. 10-16 and 16A provide various views of an exterior case having an integral spring retention mechanism for retaining a set of air-less cartridges according to an embodiment of the present invention.
Figure 11:
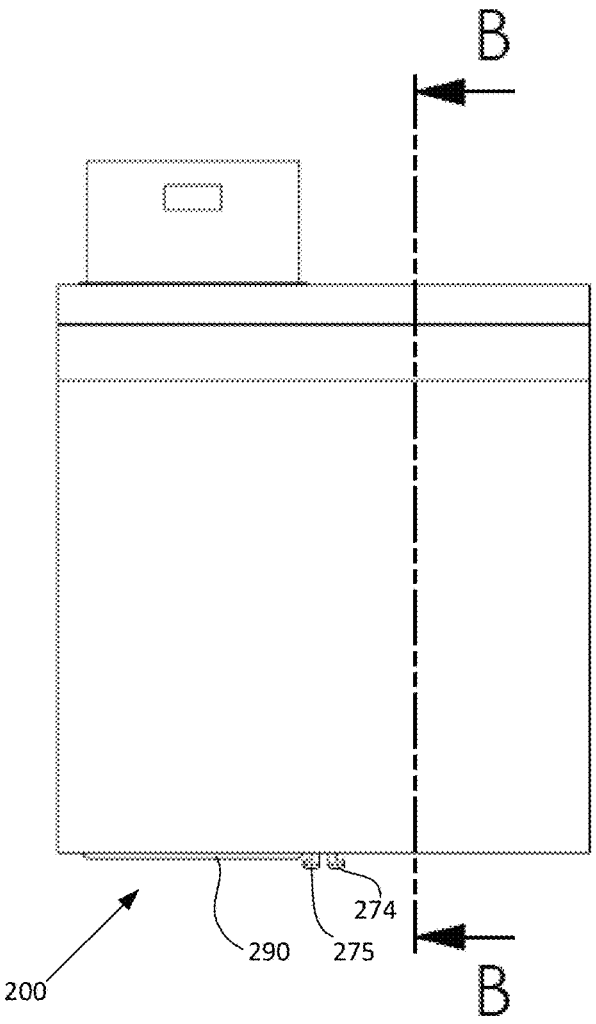
Figure 12:
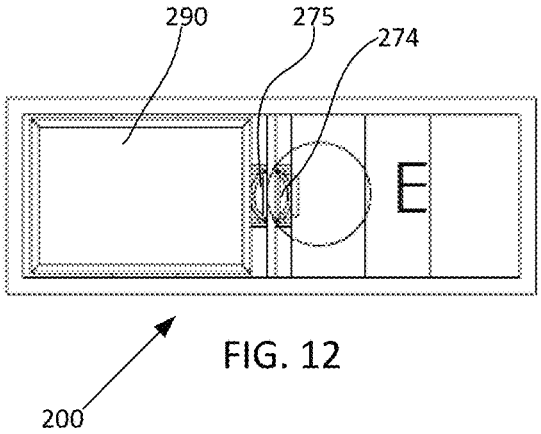

With reference now to FIGS. 10-16, various views of a dispensing system 200 comprising a case 250 having a release button locking and integral spring retention mechanism 270 for retaining a set of air-less cartridges 190 according to an embodiment of the present invention are provided. FIG. 10 provides an exploded view of the dispensing system 200. The dispensing system 200 is substantially similar to the dispensing system 100 shown in FIGS. 1-9, differing primarily in the manner in which the cartridge 290 is retained within the case 250. The dispensing system 200 comprises a dispenser 210 having an opening 200 through with product is dispensed, a pump 220 having a bottom 226, upper frame 230 with opening or home 232, case frame 240 with frame supports 246, case 520 with bottom 254, and integral spring retention mechanism 270.

Figure 13:
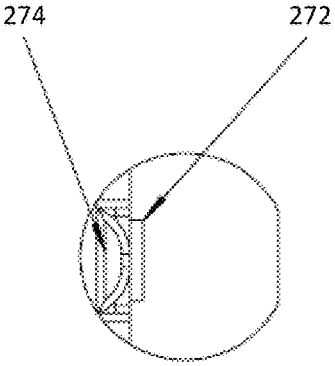
Figure 14:
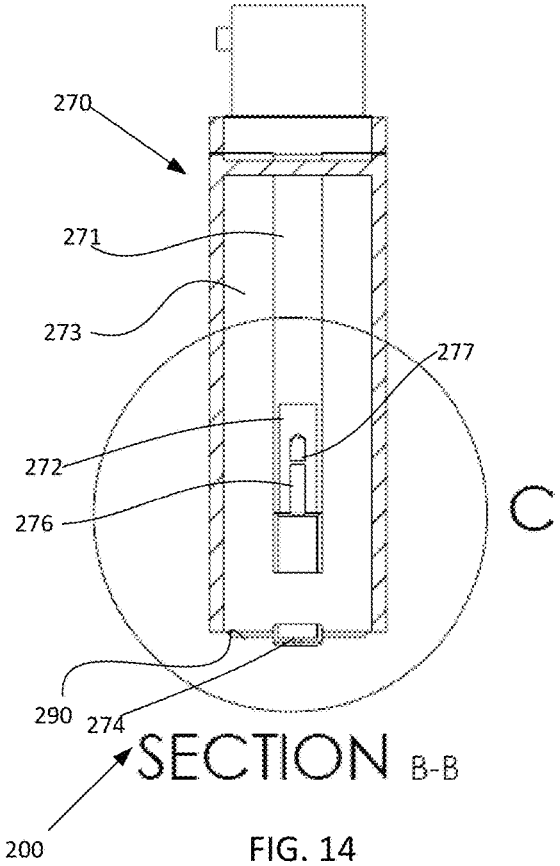
Figure 15:
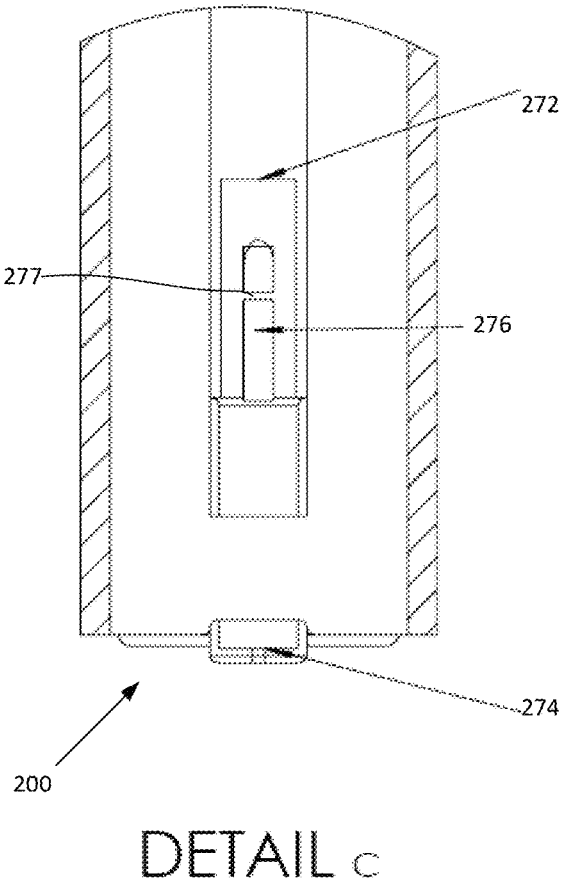
Figure 16A:
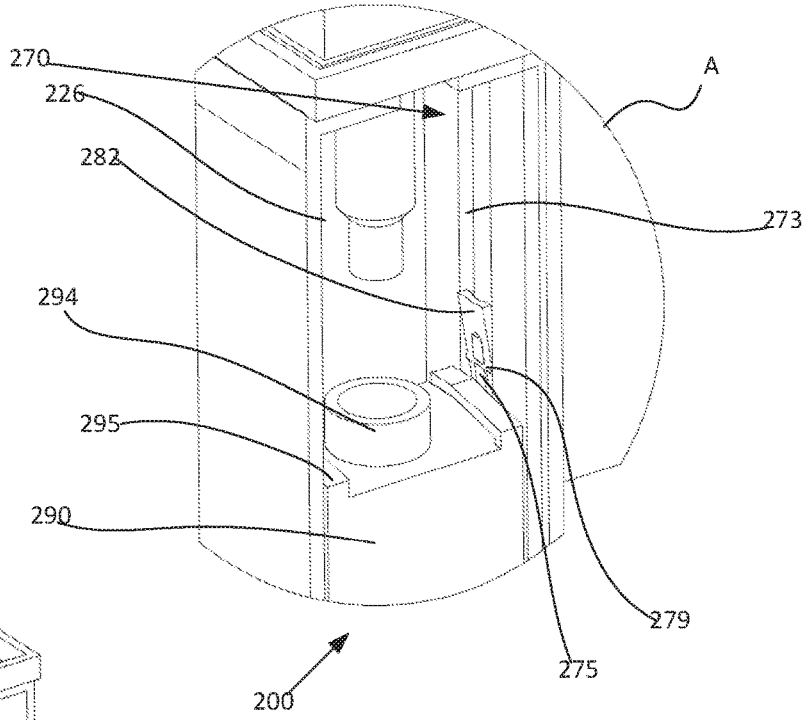
Figure 16:
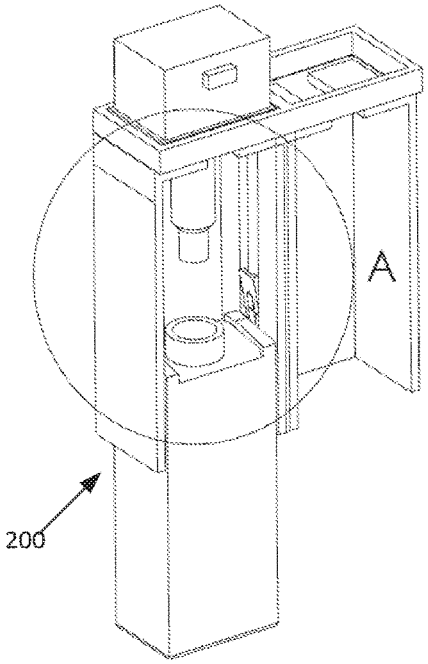
Figure 17:
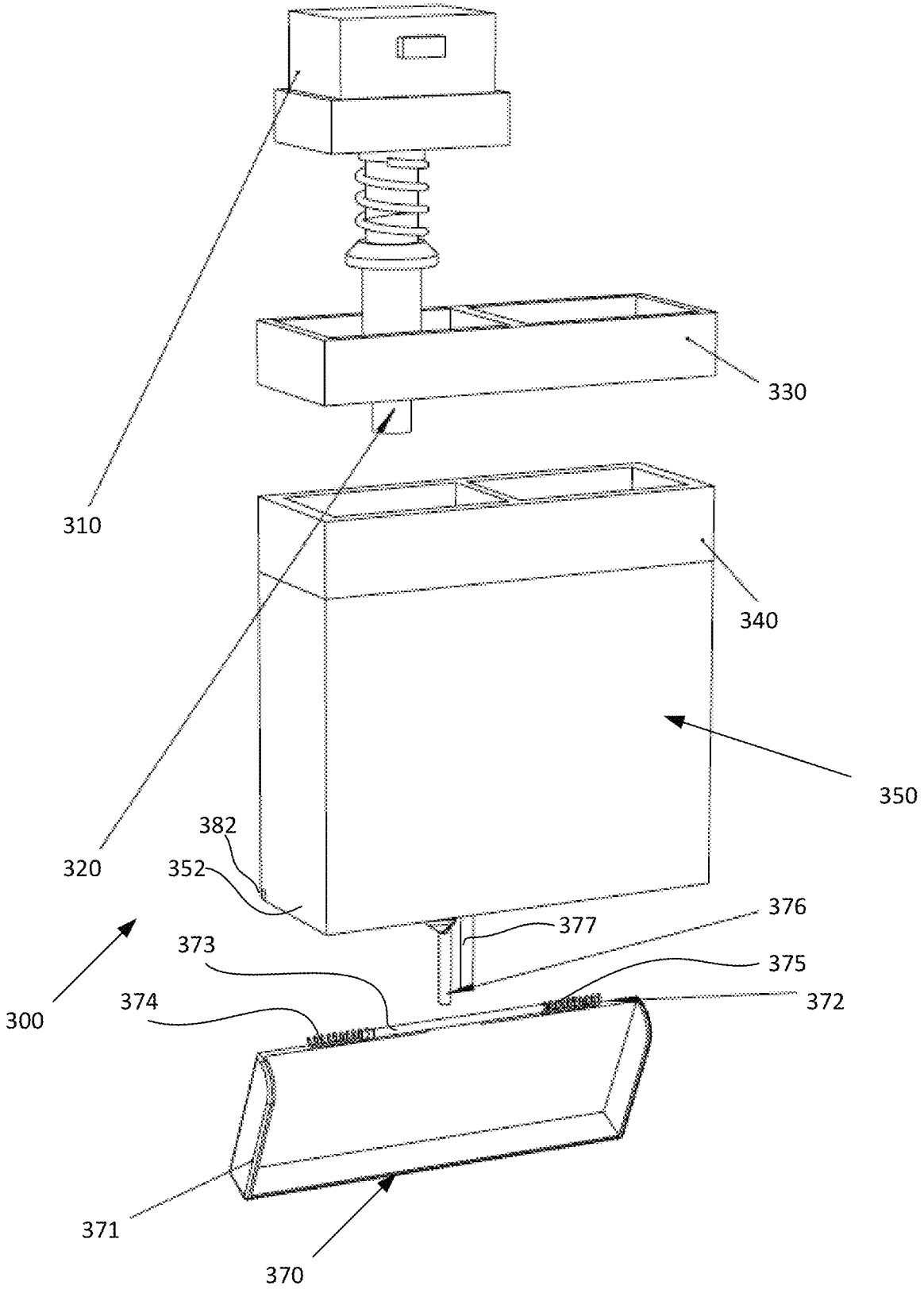
FIGS. 17-23 provide various views of an exterior case having a hinged bottom retention mechanism for retaining a set of air-less cartridges and a spring-operated piston ejection mechanism for ejecting the set of air-less cartridges according to an embodiment of the present invention.

As shown in the cross-section B-B of FIG. 14, detail section E of FIG. 13, detail section C of FIG. 15, and in FIG. 16 and in detail section A of FIG. 16A, a spring partition and guide 271 of retention partition and frame 273 in the case 250 retains releasing buttons 274 and 275 each having a corresponding locking ledge or snap 272 and 282. The releasing buttons 274 and 275 operate about respective pivots 277 and 279 to maintain the locking ledges 272 and 282 in an extended position, such that they protrude outwards into the interior of the case 150 from the frame 273. In this normally extended position, the locking ledges 272 and 282 may engage with a corresponding indentation in a cartridge 290 to lock the cartridge 290 within the case 250 when the cartridge 290 is fully inserted. User operation of the release buttons 274 or 275 will cause the release buttons to pivot about their respective pivots to move the locking ledge inwards, disengaging the locking ledge from the cartridge 290. Spring pressure from integral springs 295 and 297 of the cartridge 290 keep the cartridge 290 in a locked position and facilitate extraction of the cartridge when the corresponding release button is pressed. The opening 294 of the cartridge 290 engages with the bottom 226 of the pump 220 when the cartridge 290 is fully inserted in the case 250 and held in a locked position by a corresponding locking ledge 272 or 282 until released by user operation of a release button 274 or 275.

With this release button locking and integral spring retention mechanism 270 a user inserts the cartridge 290 until a snap is heard from the engagement of the locking ledge 272 or 282 that locks the cartridge 290 inside the case 250. In order to replace the cartridge 290 or remove the cartridge 290, the user pushes the release button 274 or 275 disposed at the bottom 254 part of the case 250 which releases the locking ledge 272 or 282 and corresponding cartridge 290.

With reference now to FIGS. 17-23 various views of a dispensing system 300 comprising an exterior case 350 having a hinged bottom retention mechanism 370 for retaining a set of air-less cartridges 390 and a spring-operated piston ejection mechanism 376 and 377 for ejecting the set of air-less cartridges 390 according to an embodiment of the present invention are provided. In the embodiment of the dispensing system 300 shown in the exploded view of FIG. 17, the dispensing system comprises a dispenser 310, pump 320, upper frame 330, case frame 340, case 350 having a bottom 352, and a hinged bottom retention mechanism 370 for retaining a set of air-less cartridges 390 and a spring-operated piston ejection mechanism 376 and 377 for ejecting the set of air-less cartridges 390.

Figure 18:
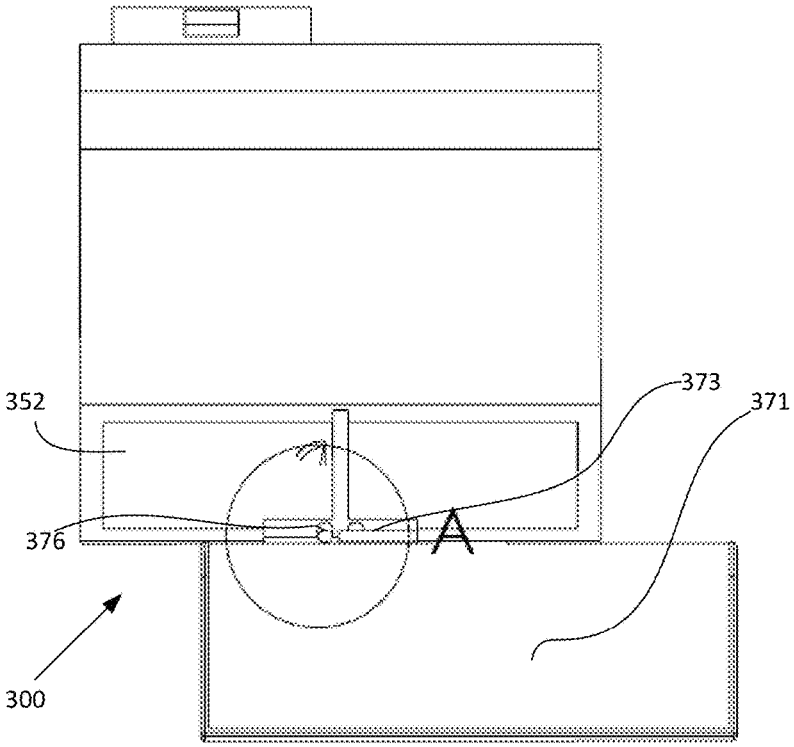
Figure 20:
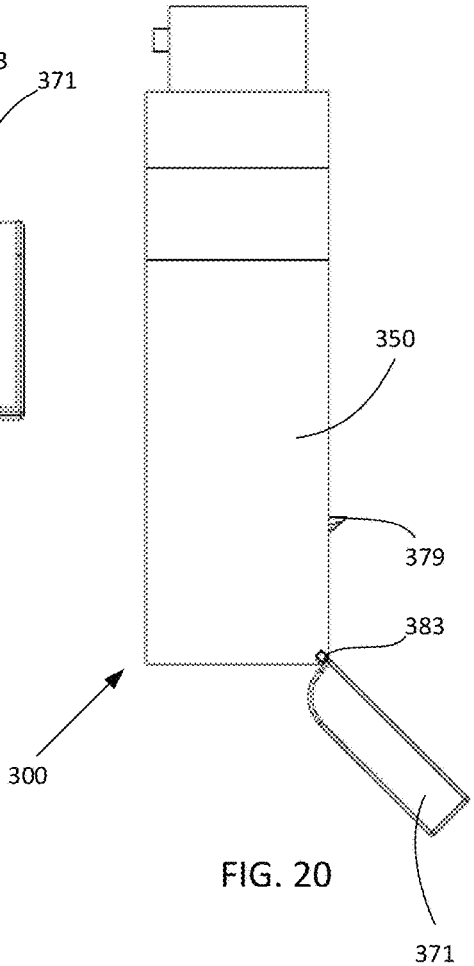
Figure 19:
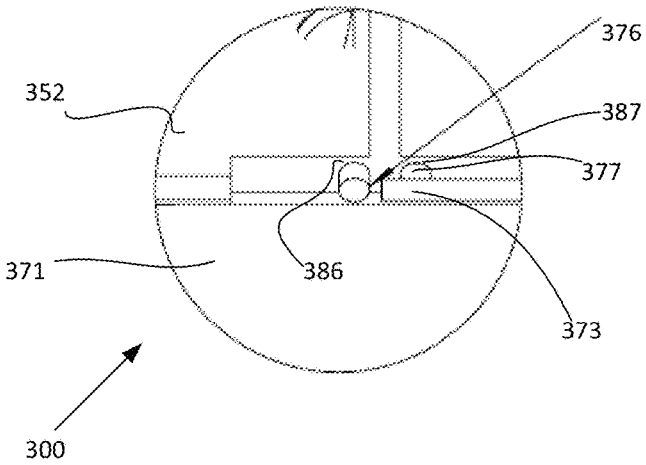
Figure 21:
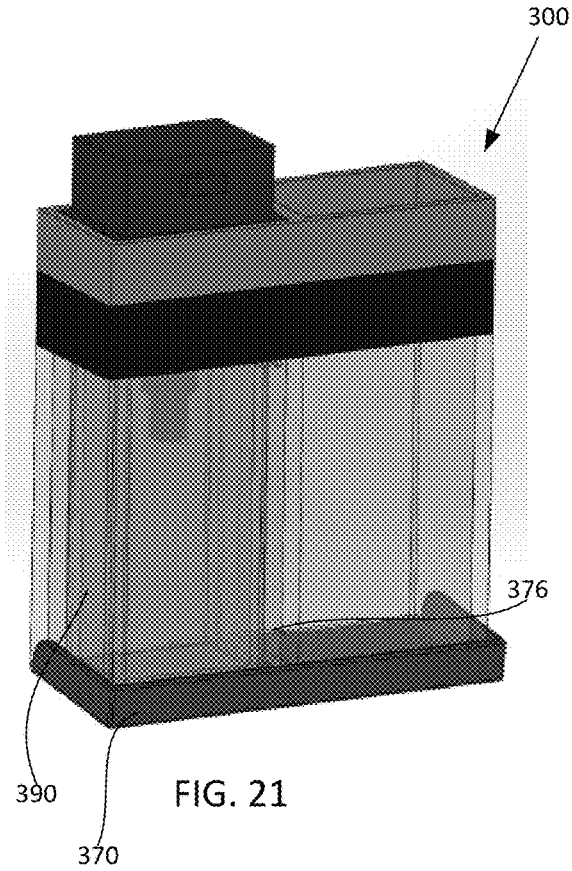
Figure 22:
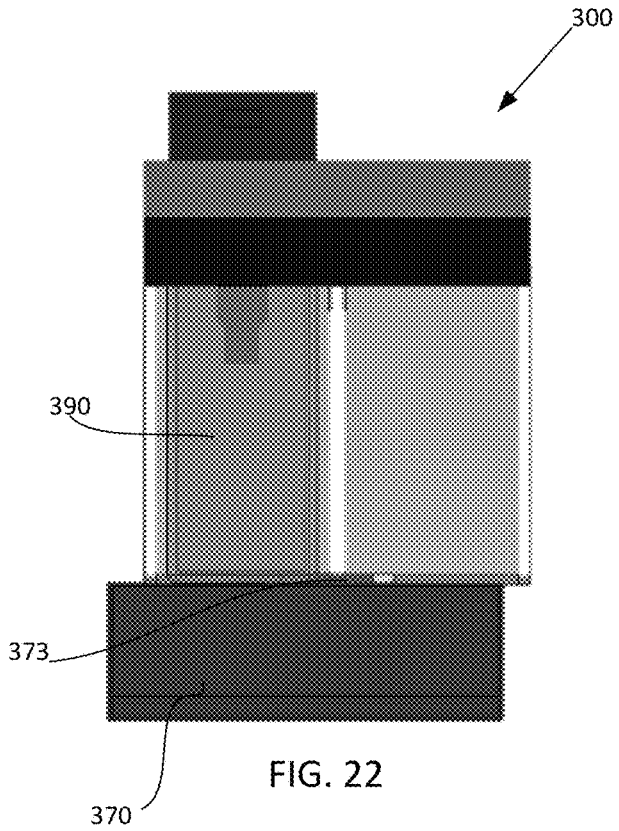
Figure 23:
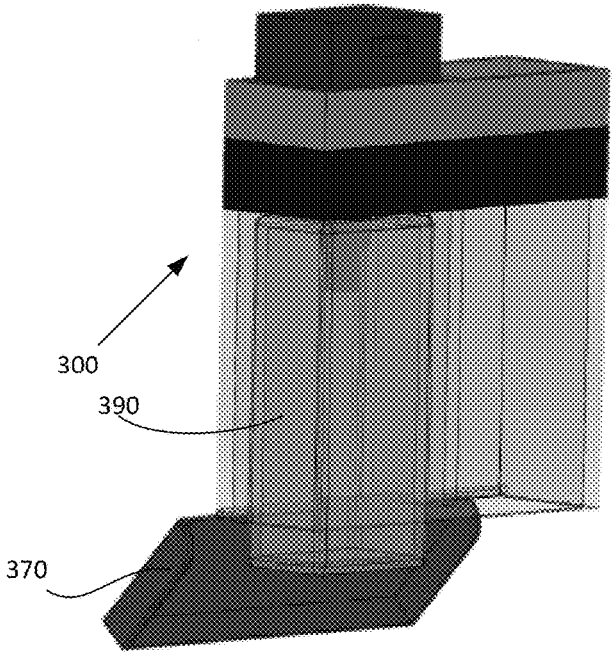

The hinged bottom cover 371 of the hinged bottom mechanism 370 pivots about posts 382 and 383, but may also be held in place and pivot about other suitable means such as a set of one or more pins or screws. The hinged bottom cover 371 may operate or slide from left to right and is held in and returned to a central or neutral position by springs 374 and 375. In a central position, the hinge 373 blocks the pistons 376 and 377, which are disposed in corresponding openings 386 and 387 in the case 350. When operated or moved by a user to a fully left (as shown in FIG. 22) or fully right (as shown in FIG. 18) position, the hinge 373 no longer blocks one or the other of the pistons 376 and 377. The pistons 376 and 377 may be spring operated or may be mechanically operated by a button or lever 379. The pistons 376 and 377 function to operate on a portion of a cartridge 390 to eject the cartridge 390 from the case 350 when the cartridge 390 is to be replaced.

The user inserts the cartridge 390 which is automatically locked when it reaches the top of the case 350 and engages with the pump 320. In order to release the cartridge 390 the user first opens the bottom cover 371 and cartridges stay at place. Upon pushing the cover 371 to its right or to its left the corresponding cartridge is released. When rotated open past a certain angle the bottom cover 371 can move to the left or right to eject a cartridge. When moving the cover 371 to the left side it extracts the left cartridge and when moving the cover 371 to the right side it extracts the right cartridge. The bottom cover 371 is normally operated to the center neutral position by the springs 374 and 375.

In another embodiment, as shown in FIGS. 24-26, various views of a dispensing system 400 having a dual-hinged bottom retention mechanism 470 for retaining a set of air-less cartridges 490 according to an embodiment of the present invention are provided. The dispensing system 400 shown in FIGS. 24-26 may be substantially similar to the system 300 shown in FIGS. 17-23 except that the retention mechanism 470 comprises a set of doors 472 and 474. The retention mechanism 470 may comprise pistons similar to the mechanism 370 shown with the dispensing system 300.

Figure 28:
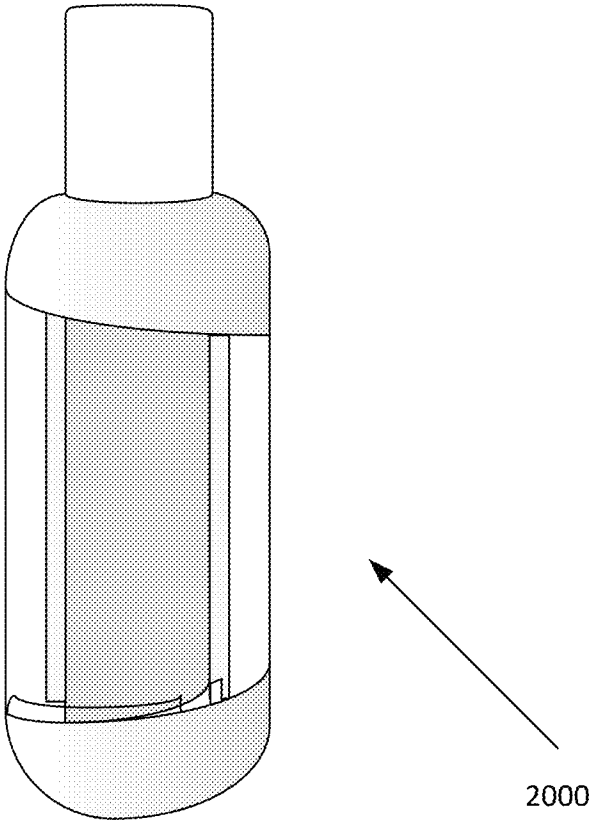
FIG. 28 provides a side view of an air-less cartridge dispensing system having a two-piece sleeve housing comprising an outer glass sleeve housing and an inner plastic housing according to an embodiment of the present invention.
Figure 27:
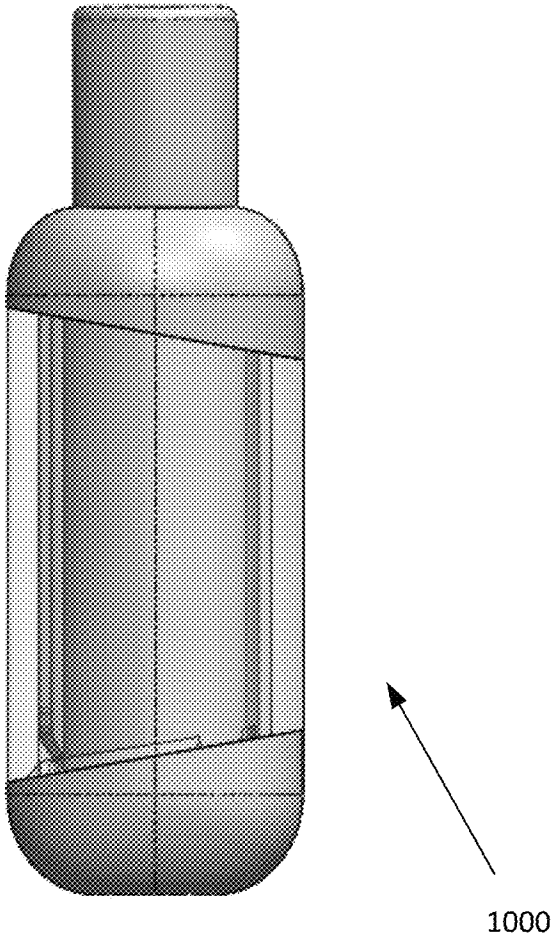
FIG. 27 provides a side view of an air-less cartridge dispensing system having a one-piece glass sleeve housing according to an embodiment of the present invention.
Figure 54:
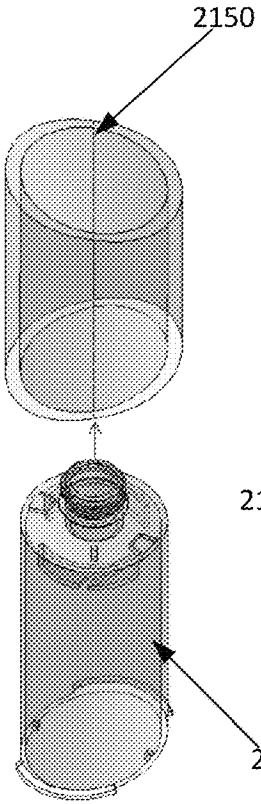

With reference now to FIG. 27, a side view of an air-less cartridge dispensing system 1000 having a one-piece glass sleeve housing according to an embodiment of the present invention is provided. Another embodiment, shown in FIG. 28 which provides a side view of an air-less cartridge dispensing system 2000, comprises a two-piece sleeve housing comprising an outer glass sleeve housing and an inner plastic housing. Both the dispensing systems 1000 and 2000 accept a removable, replaceable, air-less cartridge, such as the cartridge 3000 shown in FIG. 54, and dispense a fluid, such as make-up, by manual operation of a pump of the dispensing system.

With reference now to FIGS. 29-40, various perspective views of the components of the air-less cartridge dispensing system 1000 having a one-piece glass sleeve housing are provided. The dispensing system 1000 comprises a glass sleeve 1100, upper retaining cover 1200, lower retaining cover 1300, cartridge carrier 1400, and pump assembly 1500. As shown in FIGS. 37-40 the upper retaining cover fits on top of the glass sleeve 1100 and may be secured by locking or friction fit tabs, or by an adhesive. Pump assembly 1500 screws onto the upper retaining cover 1200. The cartridge carrier 1400 clips into or is secured by an adhesive into the lower retaining cover 1300 and is inserted into the glass sleeve 1100 where it is locked in place.

Returning to FIG. 29, the glass sleeve 1100 comprises a body 1102, interior 1104, top lip 1106, bottom 1108, alignment notch 1110, locking tab 1112, alignment tab 1114, and clearance cutout 1116. The glass sleeve 1100 may be extruded glass, acrylic, or any other suitable material. The upper retaining cover 1200, shown in FIG. 30, comprises a body 1202 and a threaded opening 1204. The upper retaining cover 1200 may be plastic, metal, or any other suitable material. The lower retaining cover 1300, shown in FIG. 31, comprises a body 1302, interior 1304, and upper lip 1306. The lower retaining cover 1300 may be plastic, metal, or any other suitable material. The pump assembly 1500, shown in FIG. 33, comprises a pump 1502, threaded collar 1504, and dispenser 1506. The pump assembly may be any suitable pump assembly for dispensing a fluid from a sealed, air-less cartridge. The tip of the pump 1502 may be used to penetrate a seal or open an air-less cartridge to permit a fluid therein to be pumped and dispensed by operation of the pump assembly 1500.

Figures 29, 30, 31, 32, 33:
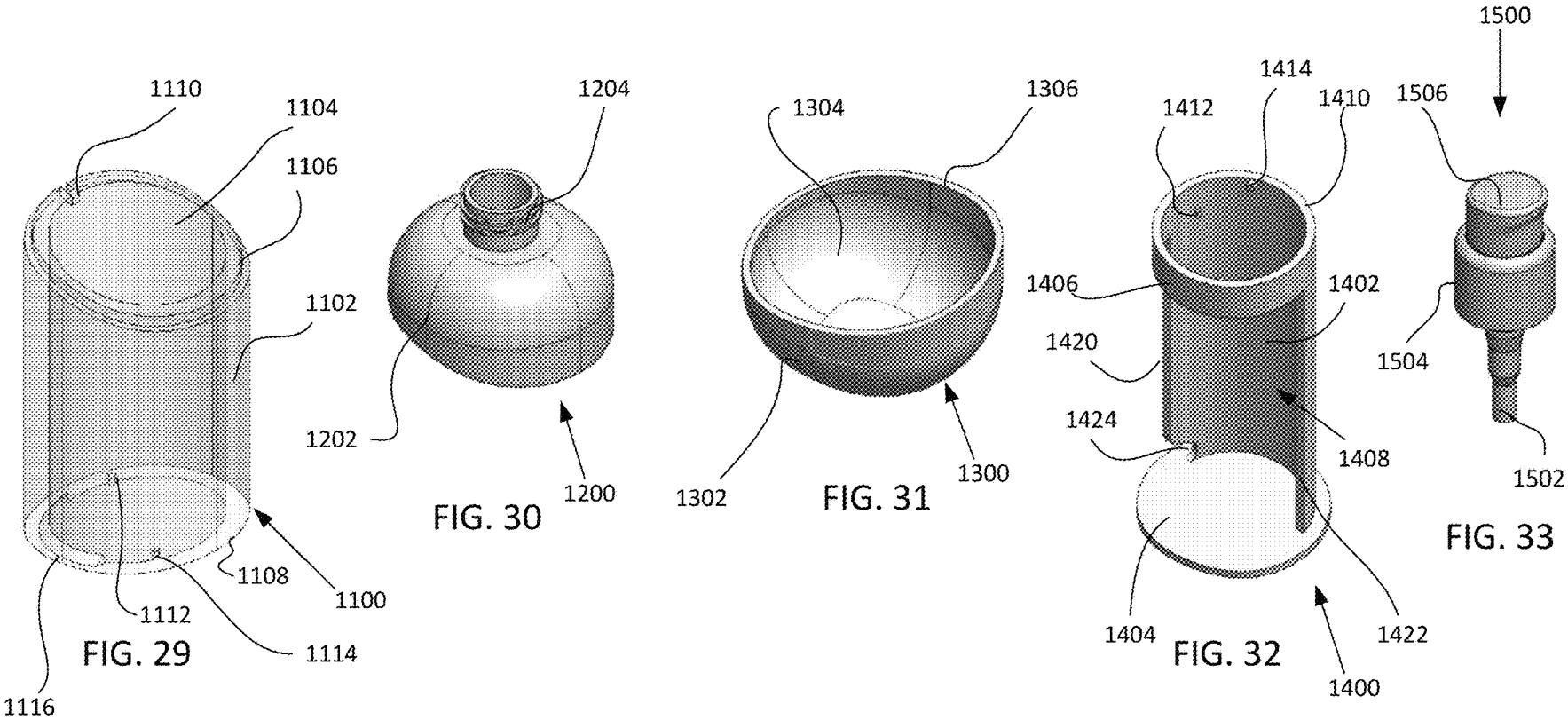
FIGS. 29-40 provide various perspective views of the components of an air-less cartridge dispensing system having a one-piece glass sleeve housing according to an embodiment of the present invention.

The cartridge carrier 1400, shown in FIG. 32, comprises a body 1402, bottom plate 1404, upper collar 1406, cartridge receiving space or opening 1408, top 1410, cartridge alignment tabs 1412, locking pins or tabs 1414, alignment edges 1420 and 1422, and locking notch 1424. The cartridge carrier 1400 may be plastic, metal, or any other suitable material. In operation, the cartridge carrier 1400 holds or retains a cartridge in the space 1408 and positions the cartridge such that when the carrier 1400 is fully inserted into the sleeve 1100 the pump assembly 1500 engages with the cartridge such that a pumping operation of the pump assembly 1500 dispenses a fluid from the cartridge.

Figure 34:
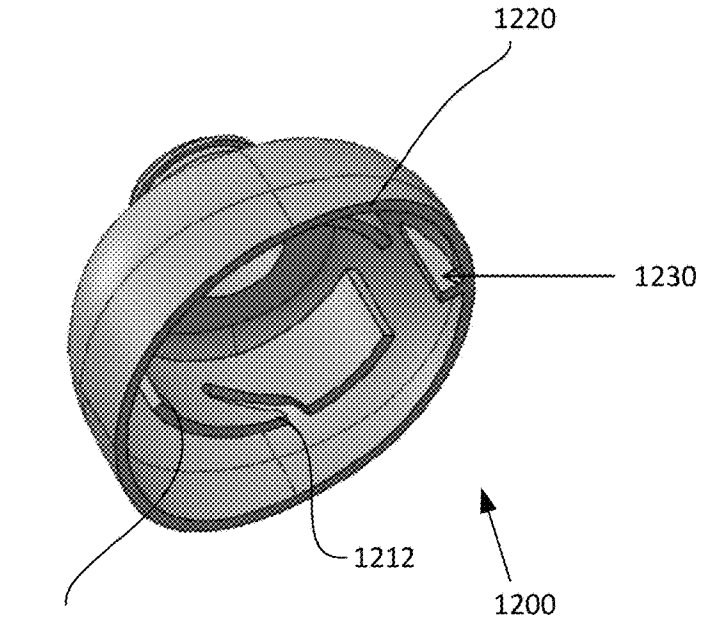

With reference now to FIG. 34, a bottom perspective view of the upper retaining cover 1200 is provided. An alignment tab 1230 corresponds to the notch 1110 of the sleeve 1100 aligns the upper retaining cover 1200 with the sleeve 1100 when mated to the sleeve 1100. A set of tabs 1210 and 1220 each comprise a cam track or locking track such as the track 1212. These tracks correspond to the locking pins 1414 of the cartridge carrier 1400. When inserted, the pins 1414 of the cartridge carrier 1400 fit into and follow the tracks 1212 until the cartridge carrier 1400 is fully inserted and locked in place.

Figure 35:
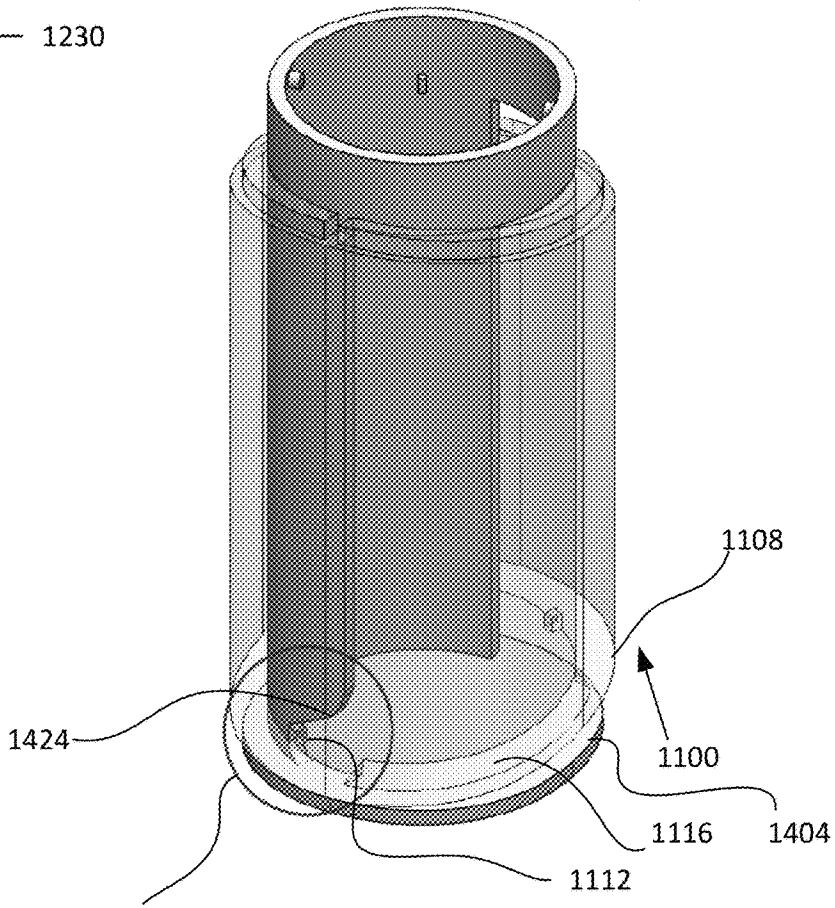
Figure 36:
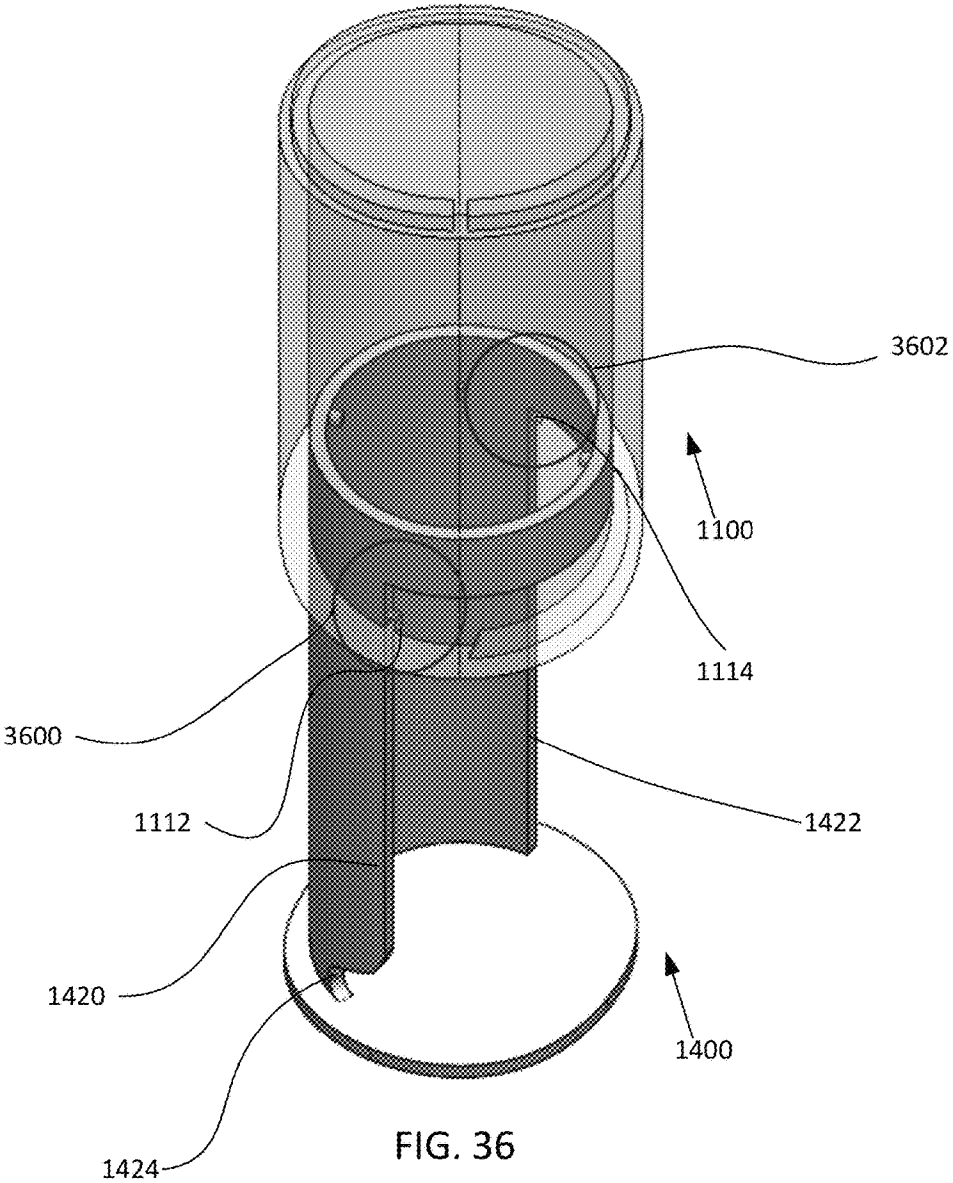
Figure 40:
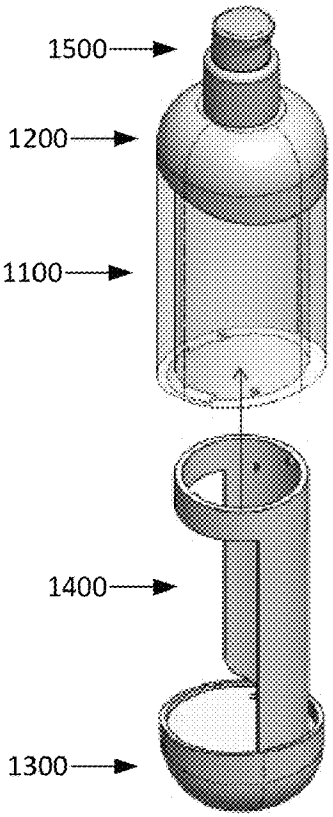
Figure 39:
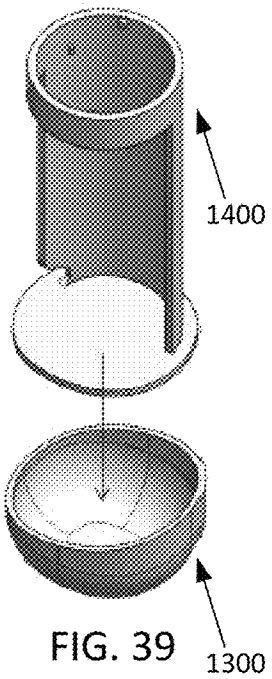
Figure 38:
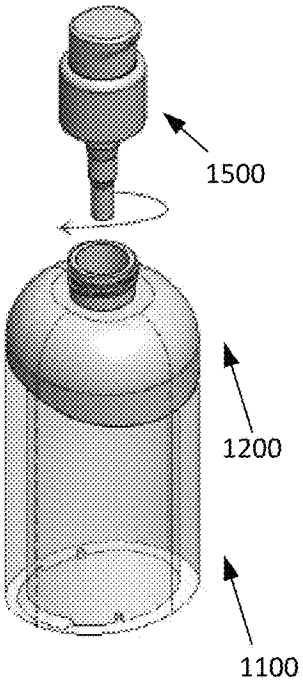
Figure 37:
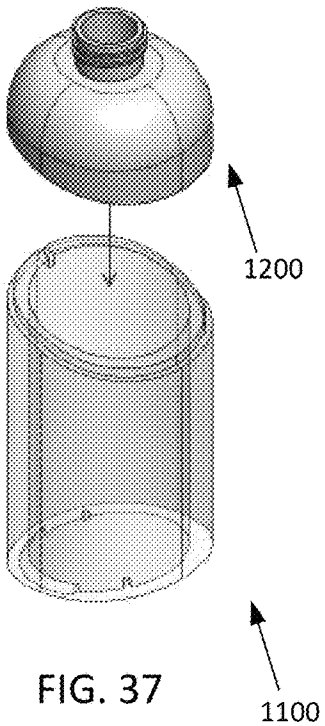

FIG. 35 illustrates the cartridge carrier 1400 fully inserted into the glass sleeve 1100. The bottom plate 1404 on which a cartridge would rest is abutting the bottom 1108 of the sleeve 1100. A cutout 1116 in the sleeve 1100 permits the cartridge to be fully inserted when the carrier 1400 is in the sleeve 1100 without interference. As shown in the area 3500, the tab 1112 would follow and abut the notch 1424 when the carrier 1400 is fully inserted and rotated into position. FIG. 36 illustrates the carrier 1400 partially removed from the sleeve 1100. In the area 3600 the locking tab 1112 abuts the alignment edge 1420 of the carrier 1400 and in the area 3602 the alignment edge 1422 abuts the alignment tab 1114. The tabs 1112 and 1114 follow and guide the respective edges 1420 and 1422 until the carrier 1400 is fully inserted into the sleeve 1100. When fully inserted into the sleeve 1100, the carrier 1400 may be partially rotated with the locking tab 1112 following the corresponding shape of the notch 1424 until the carrier is fully locked in place in the upper retaining cover 1200.

With reference now to FIGS. 41-58, various perspective views of the components of an air-less cartridge dispensing system 2000 having a two-piece sleeve housing comprising an outer glass sleeve housing and an inner plastic housing are provided.

In contrast to the single sleeve dispensing system 1000, the dispensing system 2000 shown in FIGS. 41-58 comprises a two-piece sleeve construction with an inner plastic sleeve 2100, an outer glass sleeve 2150, and further comprises upper retaining cover 2200, lower retaining cover 2300, cartridge carrier 2400, and pump assembly 2500. As shown in FIGS. 54-58 the inner plastic sleeve 2100 fits within the outer glass sleeve 2150 and is secured by an adhesive or by a friction fit. The upper retaining cover 2200 fits on top of the inner plastic sleeve 2100 and outer glass sleeve 2150 and may be secured by locking or friction fit tabs, or by an adhesive. Pump assembly 2500 screws onto the inner plastic sleeve 2100 and extends into the interior of the inner plastic sleeve 2100 such that it may operatively engage with a cartridge to permit a product or fluid to be pumped through and dispensed by the pump assembly. The cartridge carrier 2400 clips into or is secured by an adhesive into the lower retaining cover 2300 and is inserted into the inner plastic sleeve 2100 where it is locked in place.

Returning to FIG. 41, the inner plastic sleeve 2100 comprises a body 2102, top 2140, bottom 2106, threaded neck 2108, neck locking collar 2110, and a set of tabs 2112 and 2114 which each comprise a cam track or locking track such as the track 2116. These tracks correspond to the locking pins 2410 of the cartridge carrier 2400. The inner plastic sleeve 2100 further comprises a set of bottom lips 2122 and 2124, a locking tab 2126, and an alignment tab 2128. The inner plastic sleeve 2100 may be made from plastic, acrylic, or any other suitable material.

Figures 41, 42, 43, 44, 45, 46:
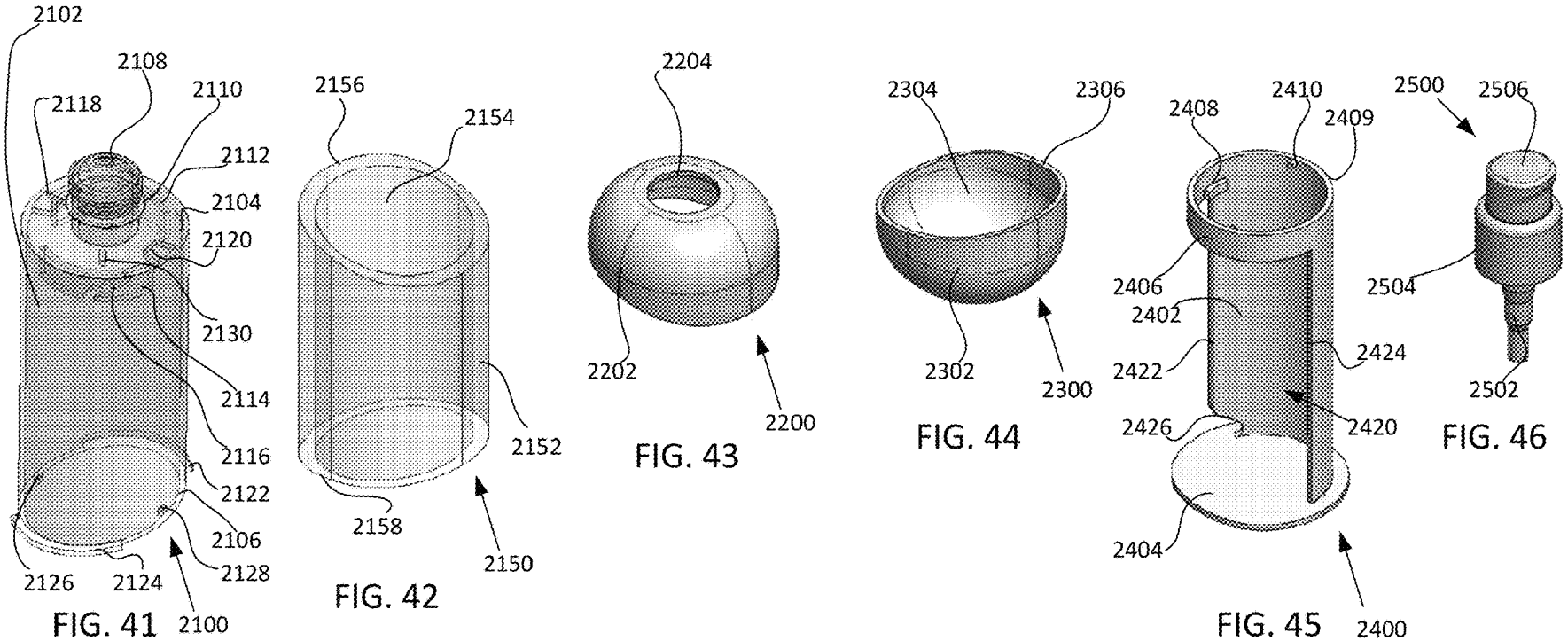
FIGS. 41-58 provide various perspective views of the components of an air-less cartridge dispensing system having a two-piece sleeve housing comprising an outer glass sleeve housing and an inner plastic housing according to an embodiment of the present invention.

With reference to FIG. 42, the glass sleeve 2150 comprises a body 2152, interior 2154, top lip 2156, and bottom 2158. The glass sleeve 2150 may be extruded glass, acrylic, or any other suitable material. The upper retaining cover 2200, shown in FIG. 43, comprises a body 2202 and an opening 2204. The upper retaining cover 2200 may be plastic, metal, or any other suitable material. The lower retaining cover 2300, shown in FIG. 44, comprises a body 2302, interior 2304, and upper lip 2306. The lower retaining cover 2300 may be plastic, metal, or any other suitable material. The pump assembly 2500, shown in FIG. 46, comprises a pump 2502, threaded collar 2504, and dispenser 2506. The pump assembly 2500 may be any suitable pump assembly for dispensing a fluid from a sealed, air-less cartridge. The tip of the pump 2502 may be used to penetrate a seal or open an air-less cartridge to permit a fluid therein to be pumped and dispensed by operation of the pump assembly 2500.

The cartridge carrier 2400, shown in FIG. 45, comprises a body 2402, bottom plate 2404, upper collar 2406, cartridge receiving space or opening 2420, top 2409, cartridge alignment tabs or alignment lugs 2408, locking pins or tabs 2410, alignment edges 2422 and 2424, and locking notch 2426. The cartridge carrier 2400 may be plastic, metal, or any other suitable material. In operation, the cartridge carrier 2400 holds or retains a cartridge in the space 2420 and positions the cartridge such that when the carrier 2400 is fully inserted into the inner plastic sleeve 2100 the pump assembly 2500 engages with the cartridge such that a pumping operation of the pump assembly 2500 dispenses a fluid from the cartridge.

Figure 49:
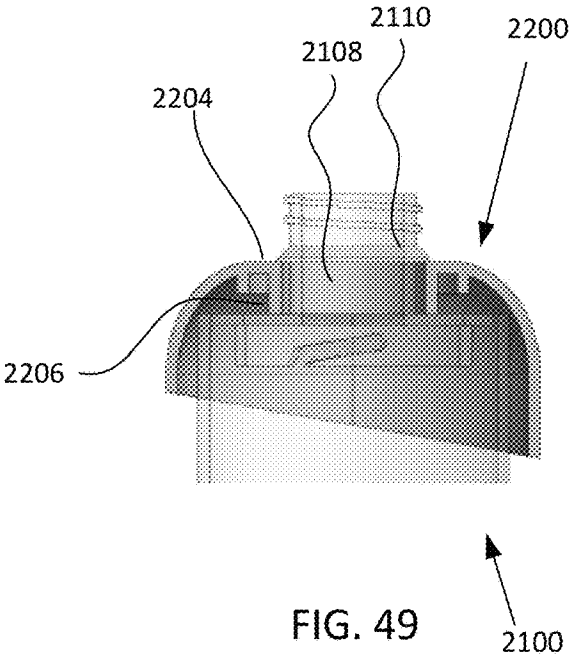
Figure 48:
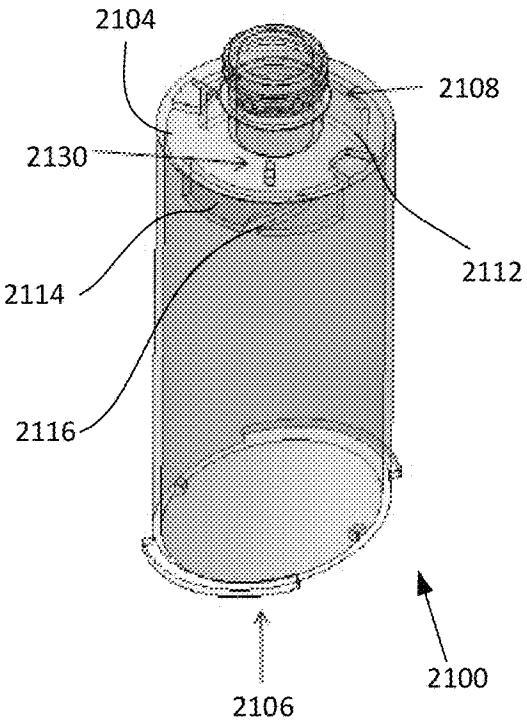
Figure 47:
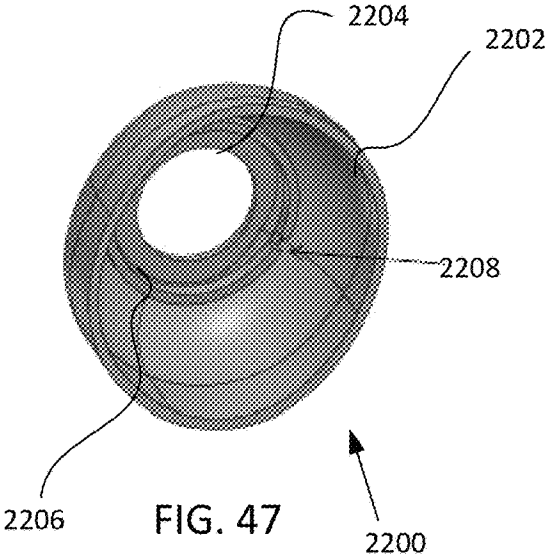

With reference now to FIGS. 47 and 48, a bottom perspective view of the upper retaining cover 2200 and a top perspective view of the inner plastic sleeve 2100 are provided. An alignment tab 2130 of the inner plastic sleeve 2100 corresponds to the notch 2208 of the upper retaining cover 2200 and aligns the upper retaining cover 2200 with the sleeve 2100 when mated to the sleeve 2100. On the inner plastic sleeve 2100 the set of tabs 2212 and 2214 each comprise a cam track or locking track such as the track 2216. These tracks correspond to the locking pins 2410 of the cartridge carrier 2400. When inserted, the pins 2410 of the cartridge carrier 2400 fit into and follow the tracks 2116 until the cartridge carrier 2400 is fully inserted and locked in place. As shown in FIG. 49, the locking collar 2110 of the threaded neck 2108 secures the threaded neck 2108 within the opening 2204 of the upper retaining cover 2200. The ring 2206 of the upper retaining cover 2200 provides proper spacing and fitment of the locking collar 2110 of the inner plastic sleeve 2110 within the opening 2204 of the upper retaining cover 2200. The outer glass sleeve 2150 would surround the inner plastic sleeve 2100 and would abut the bottom of the upper retaining cover 2200 when assembled.

Figure 51:
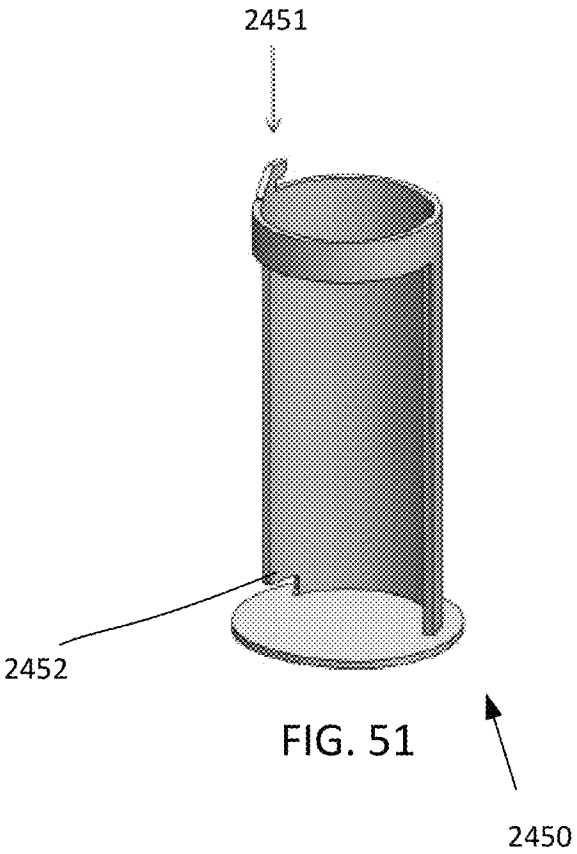
Figure 50:
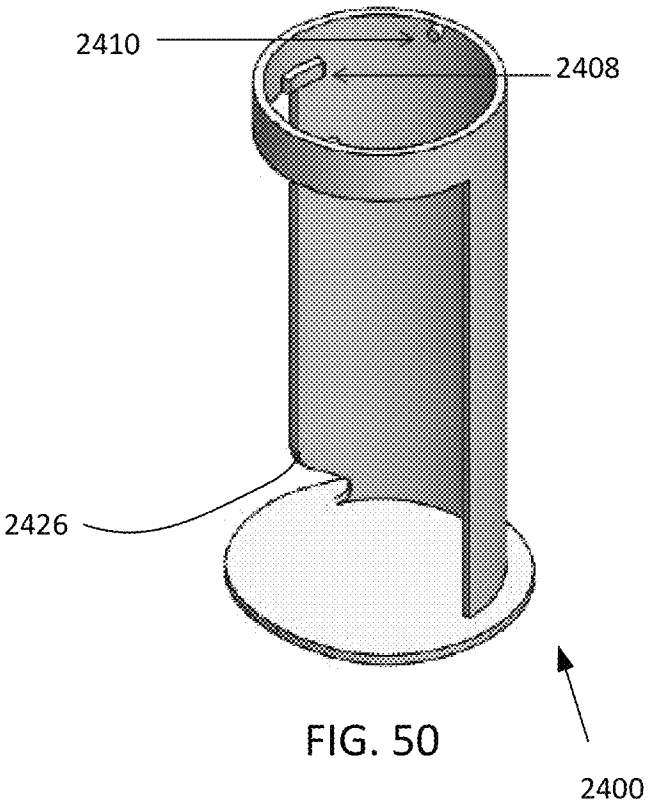

With reference now to FIGS. 50 and 51, perspective views of two alternative embodiment of a cartridge carrier are provided. The cartridge carrier 2400 is the same as the carrier 2400 shown in FIG. 45. A set of alignment or locking lugs 2408 position the carrier and cartridge correctly with respect to the inner plastic sleeve 2100. The set of locking pins or tabs 2410 engage with the locking or cam tracks 2116 of the tabs 2112 and 2114 of the inner plastic sleeve 2100 to secure the carrier 2400 and cartridge within the inner plastic sleeve 2100 when rotated into a locked position. The locking notch 2426 permits the carrier to be rotated within the inner plastic sleeve 2100 and further assists in locating and locking the carrier in an assembled or installed configuration. FIG. 51 provides a view of an alternative embodiment of a cartridge carrier. The cartridge carrier 2450 differs from the carrier 2400 in that the locking notch 2452 is more aggressively angled, and a locking tab 2451 replaces the locking lugs 2408 and locking pins 2410. The shape of the notch 2452 permits a more precise and secure fitment of the tab 2451 when engaged in a locked or installed position.

Figure 52:
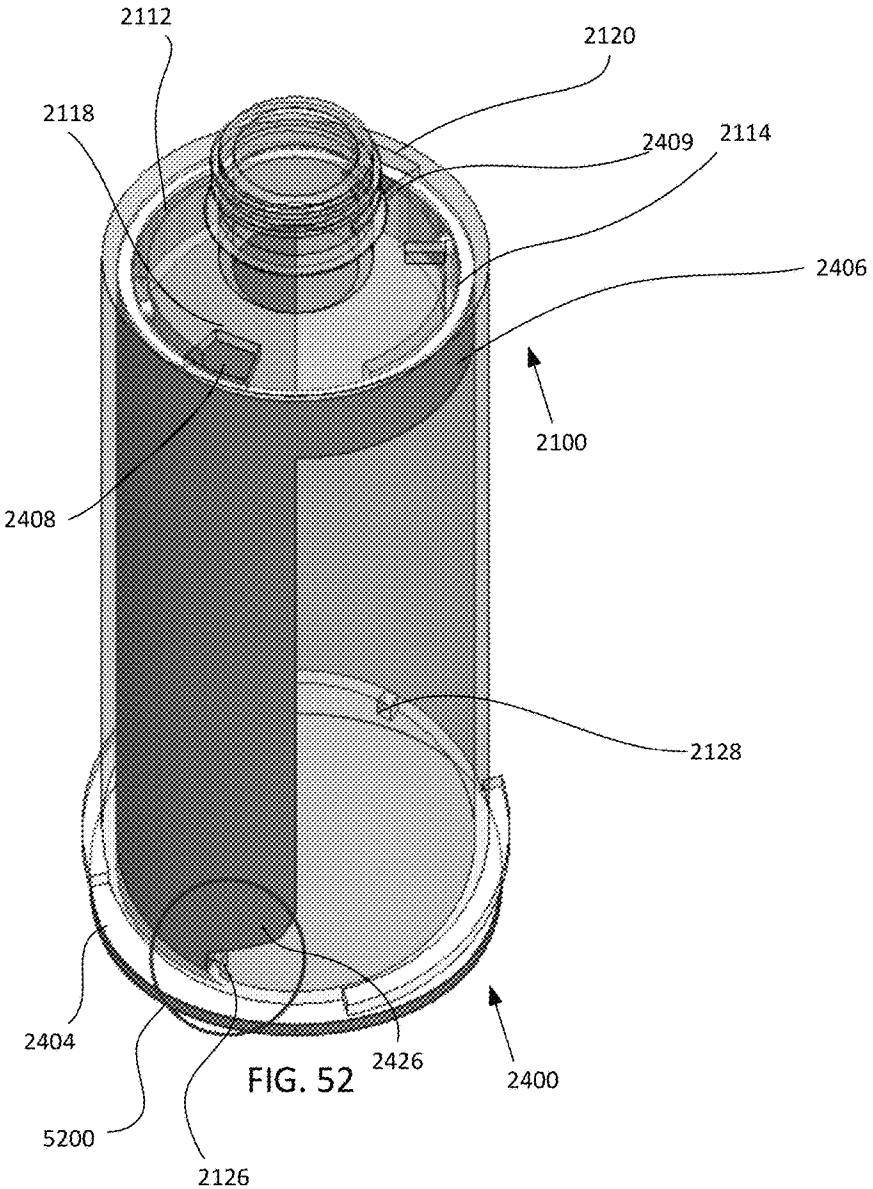

With reference now to FIG. 52, a perspective view of a cartridge carrier 2400 installed or locked into an inner plastic sleeve 2100 is provided. The operation of the carriers 1400 and 2400 is generally similar, but the carrier 2400 further comprises a set of locking lugs 2408 and 2409 and engages with the inner plastic sleeve 2100 instead of with the upper retaining cover. When engaged in an installed or locked position, the carrier 2400 has been rotated, such as by 30 degrees, into a locked position such that the locking pins 2410 are engaged with the tracks 2116 of the tabs 2112 and 2114 of the inner plastic sleeve 2100. The locking tab 2126 at the bottom of the inner plastic sleeve 2100 operates against the notch 2426 as shown in the area 5200. This tab 2126 follows the shape or contour of the notch 2426 to permit the carrier 2400 to rotate upwards into a locked or installed position. Additionally, the lugs 2408 and 2409 engage with the lug recesses 2118 and 2120 to further secure and locate the carrier 2400 when engaged into the locked or installed position and further operate to prevent unintentional disengagement. The base or bottom plate 2404 of the carrier 2400 fully abuts the bottom of the inner plastic sleeve 2100 when fully engaged in a locked or installed position or configuration.

Figure 53:
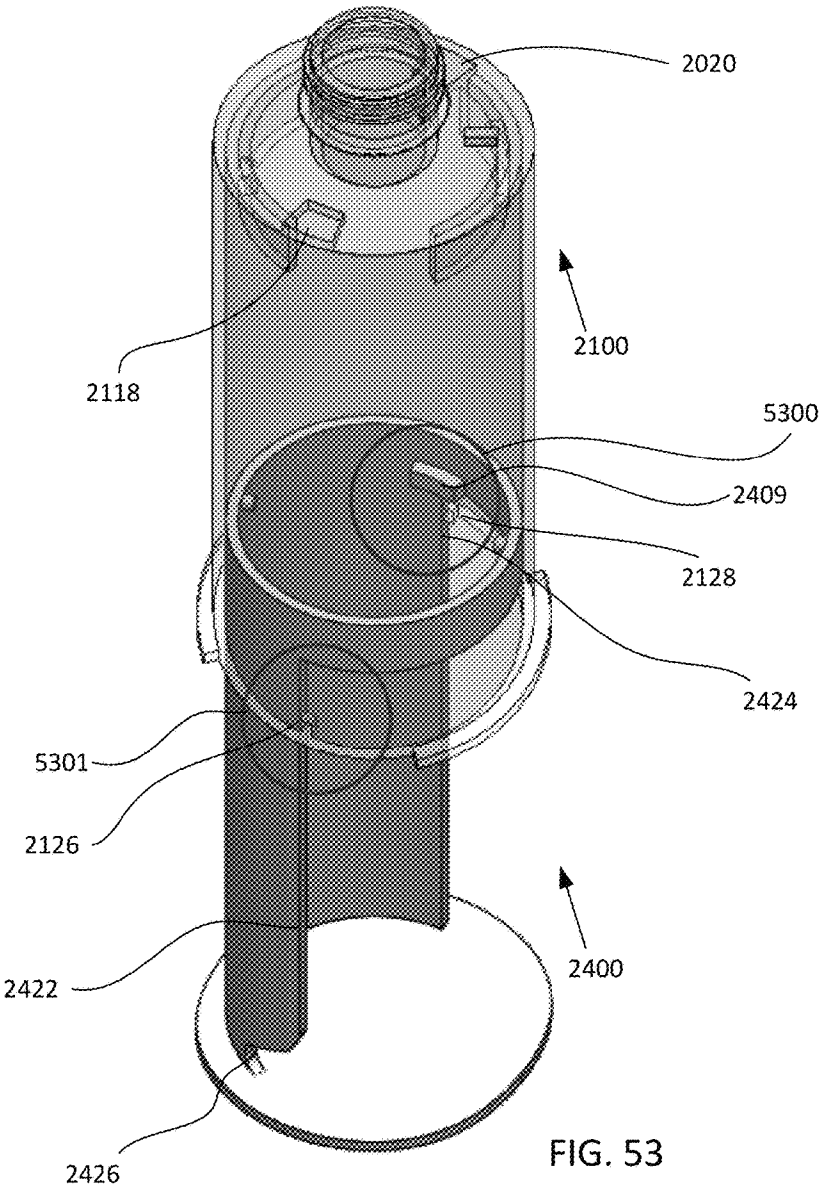
Figure 58:
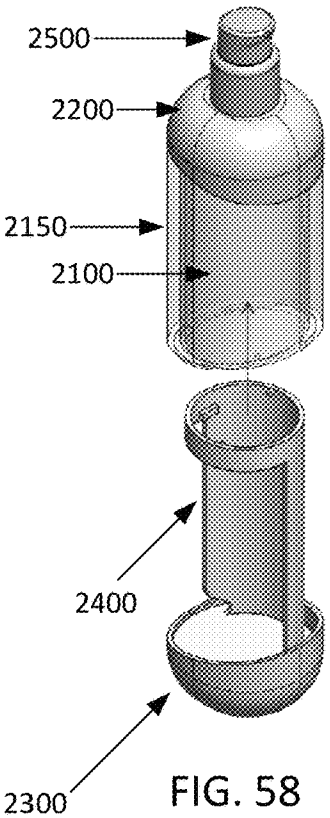
Figure 57:
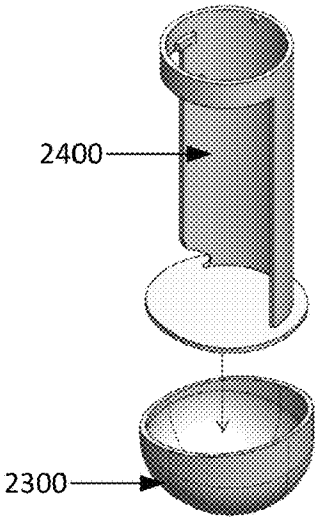
Figure 56:
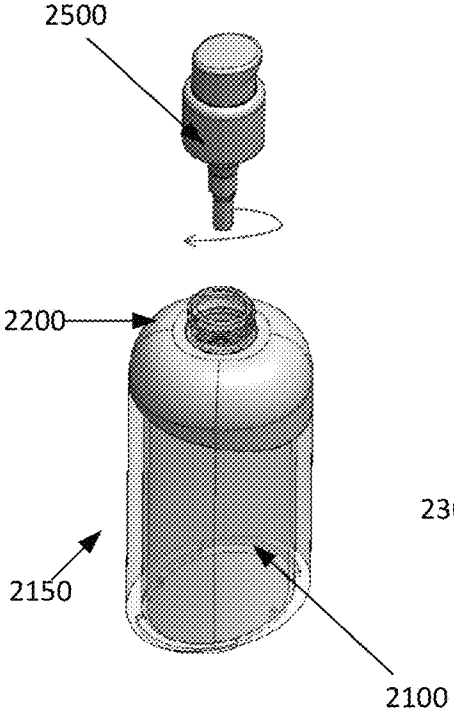
Figure 55:
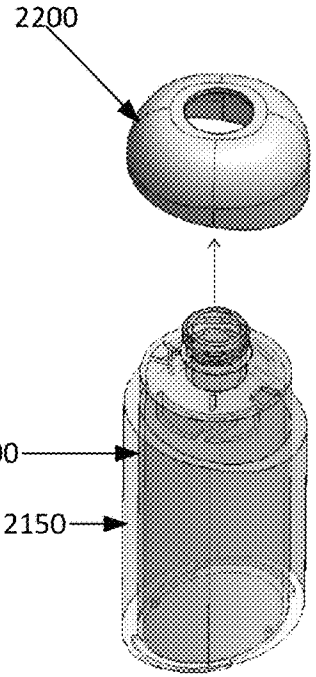

FIG. 53 illustrates the carrier 2400 partially removed from the sleeve 2100. The carrier has been counterrotated by, for example 30 degrees, to disengage the locking pins or tabs 2410 and 2126 so that the carrier 2400 can be slid down and out of the inner plastic sleeve 2100. In the area 5301 the locking tab 2126 abuts the alignment edge 2422 of the carrier 2400 and in the area 5300 the alignment edge 2424 abuts the alignment tab 2128. The tabs 2126 and 2128 follow and guide the respective edges 2422 and 2424 until the carrier 2400 is fully inserted into or removed from the sleeve 2100. When fully inserted into the sleeve 2100, the carrier 2400 may be partially rotated with the locking tab 2126 following the corresponding shape of the notch 2426 until the carrier is fully locked in place in the inner plastic sleeve 2100.

Figure 59:
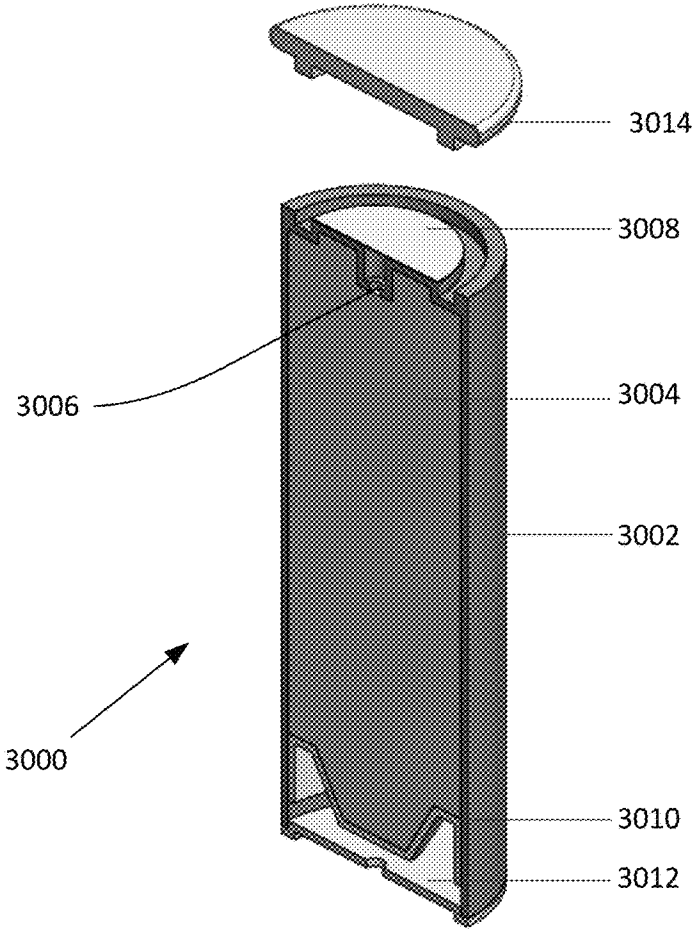
FIG. 59 provides a cross-section view of an air-less cartridge according to an embodiment of the present invention.

With reference now to FIG. 59, a cross-section view of an air-less cartridge 3000 according to an embodiment of the present invention is provided. The cartridge 3000 comprises a housing or body 3002, interior volume 3004 which would hold a liquid such as make-up, dispensing opening 3006, seal or cover 3008, piston 3010, bottom cap 3012, and top cap 3014. The seal or cover 3008 may be a foil or plastic cover to provide sterile or air-tight seal and to provide an indication of first use or tampering if damaged. As fluid is pumped from the interior volume 3004 of the cartridge 3000, the piston 3010 would move with the fluid such that no space or air would be permitted in the interior volume 3004. The cartridge 3000 may be, for example a smaller sized cartridge, for example between 30 ml and 37 ml, or a larger sized cartridge, for example between 50 ml and 60 ml. The top cap 3014 may be used to reseal a cartridge 3000 if it is removed before it has been fully used or depleted.

Figure 60:
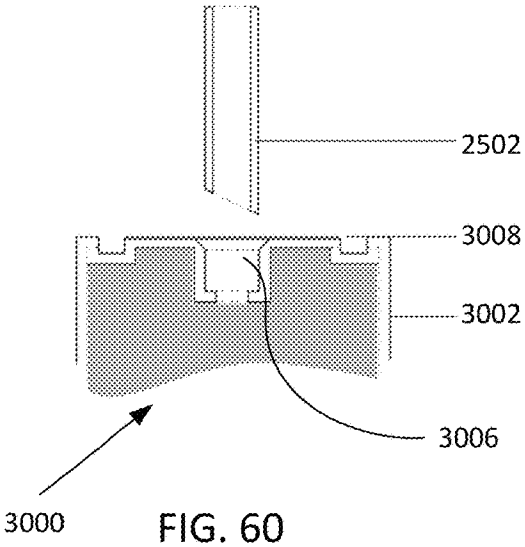
FIGS. 60-62 provide cross-section views of a pump engaging with an air-less cartridge according to an embodiment of the present invention.
Figure 61:
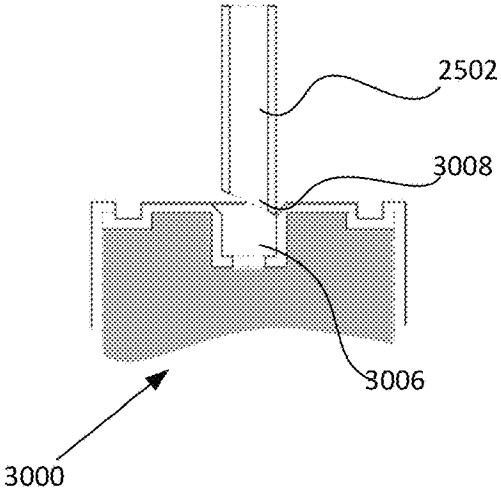
Figure 62:
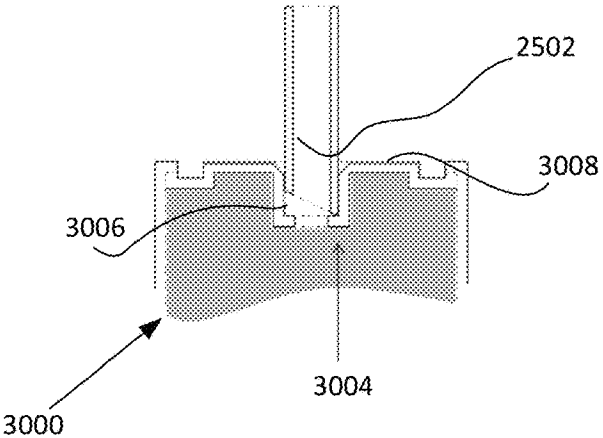

FIGS. 60-62 provide cross-section views of a pump 2502 engaging with an air-less cartridge 3000 according to an embodiment of the present invention. The pump 2502 may also be the pump 1502. In FIG. 60, as the cartridge 3000 is moved upwards by the cartridge carrier, the tip of the pump 2502 approaches the seal 3008 which covers the fluid dispensing opening 3006 of the body 3002. In FIG. 61, the tip of the pump 2502 pierces the seal or cover 3008 providing a pathway or opening for a product or fluid to flow from the interior volume 3004 through the opening 3006. In FIG. 62, the pump 2502 is fully engaged with the dispensing opening 3006 to provide a fluid-tight seal such that air may not ingress into the interior volume 3004 and to permit the fluid or product to flow from the interior volume 3004 through the dispensing opening 3006 when the pump 2502 is operated.

Figures 63, 64, 65, 66, 67, 68:
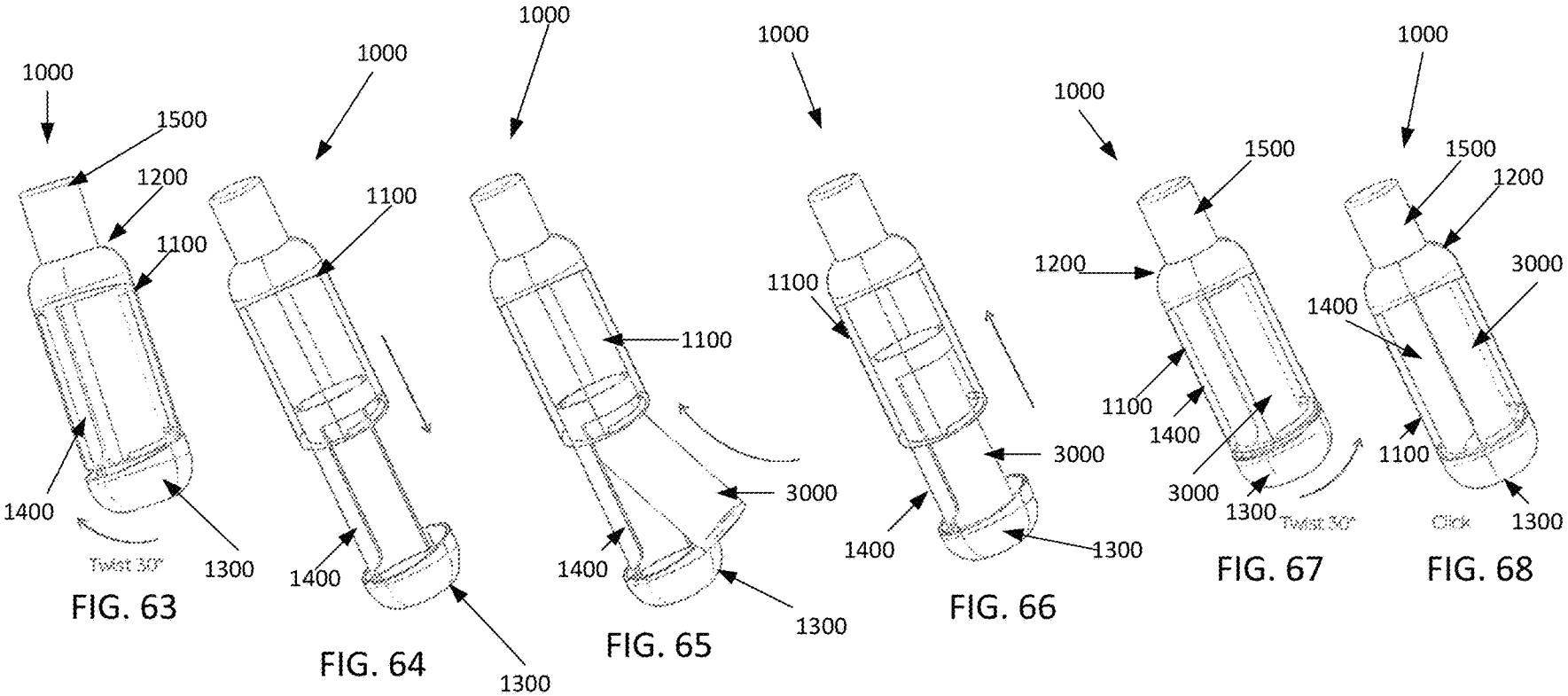
FIGS. 63-68 provide a set of perspective views of the steps for installing an air-less cartridge into the air-less cartridge dispensing system having a one-piece sleeve housing according to an embodiment of the invention.

FIGS. 63-68 provide a set of perspective views of the steps for installing an air-less cartridge 3000 into the air-less cartridge dispensing system 1000 having a one-piece sleeve housing. A similar process would be used with the dispensing system 2000. When empty and with no cartridge installed in the dispensing system 1000, the lower retaining cover 1300 may be manually rotated, such as by 30 degrees, to disengage the carrier 1400 from the upper retaining cover 1200. The carrier 1400 may then be moved downwards to provide an opening for the insertion of a cartridge 3000. The cartridge 3000 is then inserted into the carrier 1400. With the cartridge inserted into the carrier 1400, the cartridge 3000, carrier 1400, and lower retaining cover 1300 may be moved or operated upwards or inwards as guided by the locking and guiding tabs of the sleeve 1100. When moved fully upwards, the pump assembly 1500, shown under a cap, engages with the cartridge 3000 as shown in FIGS. 61-62. The lower retaining cover 1300 may then be rotated to fully engage the cartridge 3000 and carrier 1400 in a locked or installed position with the sleeve 1100 until a click is heard as shown in FIG. 68.

While the invention has been described by reference to certain preferred embodiments, it should be understood that numerous changes could be made within the spirit and scope of the inventive concept described. Also, the present invention is not to be limited in scope by the specific embodiments described herein. It is fully contemplated that other various embodiments of and modifications to the present invention, in addition to those described herein, will become apparent to those of ordinary skill in the art from the foregoing description and accompanying drawings. Thus, such other embodiments and modifications are intended to fall within the scope of the following appended claims. Further, although the present invention has been described herein in the context of particular embodiments and implementations and applications and in particular environments, those of ordinary skill in the art will appreciate that its usefulness is not limited thereto and that the present invention can be beneficially applied in any number of ways and environments for any number of purposes. Accordingly, the claims set forth below should be construed in view of the full breadth and spirit of the present invention as disclosed herein.

What is claimed is:

1. A dispenser for dispensing a product from a cartridge, the dispenser comprising:
- a pump assembly;
- an upper retaining cover comprising a neck and a set of locking tracks;
- a lower retaining cover;
- a sleeve secured at a top end to the upper retaining cover, the sleeve comprising a locking tab and an alignment tab at a bottom of the sleeve;
- a cartridge carrier comprising:
  - an upper collar comprising a set of locking pins and a set of alignment tabs;
  - a body comprising a cartridge opening, a set of alignment edges, and a locking notch; and
  - a bottom plate;
- wherein the cartridge carrier is adapted to be inserted into the sleeve such that the locking tab and the alignment tab of the sleeve align and guide the set of alignment edges of the body of the carrier as the carrier is moved upwards into the sleeve;
- wherein the locking tab of the sleeve moves correspondingly to the locking notch of the body of the carrier to guide the set of locking pins of the carrier into a locking engagement with the set of locking tracks of the upper retaining cover.

2. The dispenser of claim 1, wherein the cartridge carrier is adapted to receive, secure, and position a cartridge in the cartridge opening.

3. The dispenser of claim 2, wherein the cartridge carrier is adapted to move the cartridge into an engaged position with the pump assembly such that a product in the cartridge may be dispensed by operation of the pump.

4. The dispenser of claim 1, wherein the sleeve is a glass sleeve.

5. The dispenser of claim 1, wherein the sleeve further comprises a cutout at the bottom to permit a cartridge to be fully inserted into the sleeve.

6. The dispenser of claim 1, wherein:
- the sleeve further comprises an upper alignment notch; and
- the upper retaining cover further comprises an alignment tab corresponding to the upper alignment notch of the sleeve to permit proper alignment between the sleeve and the upper retaining cover.

7. The dispenser of claim 1, wherein the neck of the upper retaining cover is a threaded neck which corresponds to a threaded collar of the pump assembly such that the threaded collar of the pump assembly may be threaded onto the threaded neck.

8. A dispenser for dispensing a product from a cartridge, the dispenser comprising:
- a pump assembly;
- an upper retaining cover;
- a lower retaining cover;
- an inner sleeve comprising a neck, a set of locking tracks, a locking tab, and an alignment tab at a bottom of the inner sleeve, the inner sleeve secured at a top to the upper retaining cover;
- an outer sleeve corresponding to and disposed about the inner sleeve;
- a cartridge carrier comprising:
  - an upper collar comprising a set of locking pins and a set of locking lugs;
  - a body comprising a cartridge opening, a set of alignment edges, and a locking notch; and
  - a bottom plate;
- wherein the cartridge carrier is adapted to be inserted into the inner sleeve such that the locking tab and the alignment tab of the inner sleeve align and guide the set of alignment edges of the body of the carrier as the carrier is moved upwards into the inner sleeve;
- wherein the locking tab of the inner sleeve moves correspondingly to the locking notch of the body of the carrier to guide the set of locking pins of the carrier into a locking engagement with the set of locking tracks of the inner sleeve.

9. The dispenser of claim 8, wherein the cartridge carrier is adapted to receive, secure, and position a cartridge in the cartridge opening.

10. The dispenser of claim 9, wherein the cartridge carrier is adapted to move the cartridge into an engaged position with the pump assembly such that a product in the cartridge may be dispensed by operation of the pump.

11. The dispenser of claim 8, wherein the inner sleeve is a plastic sleeve and the outer sleeve is a glass sleeve.

12. The dispenser of claim 8, wherein:
- the inner sleeve further comprises an upper alignment tab; and the upper retaining cover further comprises an alignment notch corresponding to the upper alignment tab of the inner sleeve to permit proper alignment between the inner sleeve and the upper retaining cover.

13. The dispenser of claim 8, wherein the neck of the inner sleeve is a threaded neck which corresponds to a threaded collar of the pump assembly such that the threaded collar of the pump assembly may be threaded onto the threaded neck.

14. The dispenser of claim 8, wherein the neck of the inner sleeve further comprises a locking collar adapted to secure the inner sleeve in a corresponding opening of the upper retaining cover.

15. The dispenser of claim 8, wherein the set of locking lugs of the cartridge carrier correspond to a set of recesses in the inner sleeve, and wherein the set of locking lugs are adapted to secure the cartridge carrier in a fully engaged or locked position to prevent undesired disengagement.

* * * * *